United States Patent [19]

Tabler et al.

[11] Patent Number: 4,960,207

[45] Date of Patent: Oct. 2, 1990

[54] BAKERY TRAY WITH BLIND STACKING AND UNSTACKING

[75] Inventors: Charles P. Tabler, Hamilton; Eric D. Stein, Batavia, both of Ohio

[73] Assignees: Buckhorn, Inc., Milford, Ohio; EKCO/GLACO, Inc., Humboldt, Tenn.

[21] Appl. No.: 338,300

[22] Filed: Apr. 14, 1989

Related U.S. Application Data

[63] Continuation-in-part of Ser. No. 274,500, Nov. 21, 1988.

[51] Int. Cl.[5] ..... B65D 21/04

[52] U.S. Cl. ..... 206/507; 206/386; 220/600

[58] Field of Search ..... 206/386, 501, 503, 505, 206/507, 509, 514, 595; 220/66, 69, 70

[56] References Cited

U.S. PATENT DOCUMENTS

| | | | |
|---|---|---|---|
| 3,219,232 | 11/1965 | Wilson . | |
| 3,392,875 | 7/1968 | Bockenstette . | |
| 3,819,044 | 6/1974 | Bockenstetter . | |
| 3,825,114 | 7/1974 | Johnson . | |
| 3,865,239 | 2/1975 | Herulzer | 206/507 |
| 3,934,724 | 1/1976 | Johnson . | |
| 4,000,817 | 1/1977 | Sanders et al. . | |
| 4,023,680 | 5/1977 | Thurman . | |
| 4,042,127 | 8/1977 | Brossig | 206/386 |
| 4,106,625 | 8/1978 | Carroll | 206/501 |
| 4,426,001 | 1/1984 | Stahl | 206/507 |
| 4,520,928 | 6/1985 | Wilson . | |
| 4,523,681 | 1/1985 | Kreeger | 206/507 |
| 4,588,087 | 5/1986 | Swinglery | 220/66 |
| 4,755,063 | 6/1988 | Schafer | 220/70 |
| 4,775,050 | 10/1988 | Box | 206/507 |

FOREIGN PATENT DOCUMENTS

| | | | |
|---|---|---|---|
| 2645987 | 11/1977 | Fed. Rep. of Germany | 206/509 |
| 603612 | 4/1978 | U.S.S.R. | 206/386 |
| 930867 | 7/1963 | United Kingdom | 206/509 |

OTHER PUBLICATIONS

Product Brochure, Philips Products Co., Inc., Bakester, Blinds Stacker Trays, (not dated).

*Primary Examiner*—George F. Lowrance

*Attorney, Agent, or Firm*—Fay, Sharpe, Beall, Fagan, Minnich & McKee

[57] ABSTRACT

A unitary molded plastic bakery tray, with the end walls higher than the side walls to provide a 90 degree cross-nesting, and the end walls having interengaging feet and rails to provide for 180 degree oriented high stacking and like oriented low stacking. The bottom is either a flat planar surface with chamfered bottom edges or is raised so that the tray is provided with corner structure having chamfered bottom edges. Blind stacking structure is provided by an additional outer rail on each end wall and additional outer feet on each end wall for engaging the outer rail. Alternatively, blind stacking is provided by structure along each end wall having large feet and cooperating large recesses coplanar with inner small feet and cooperating inner recesses such that the large feet can span and smoothly slide over the small recesses during blind stacking. Further, trays of different series having different stacking heights can be blind stacked on one another during stacking, but include bottom and side wall structure that prevents inter cross-nesting of trays of different series.

21 Claims, 32 Drawing Sheets

BAKERY TRAY WITH BLIND STACKING AND UNSTACKING

The present invention is a continuation-in-part of application Ser. No. 274,500, entitled Bakery Tray With Blind Stacking, by Charles P. Tabler et al., filed Nov. 1, 1988.

BACKGROUND OF THE INVENTION

The present invention relates to bakery trays that are generally rectangular with high end walls, lower side walls, and a bottom so that they may be cross-nested at a 90 degree orientation. The trays are further provided with interengaging feet and rails so that they may be stacked at high and low positions with 180 degree orientation and like orientation.

These trays are moved about singularly and in stacks by sliding across floors and other surfaces, and by movement along conveyors, such as roller or wheeled conveyors. The trays are also manually handled, for example by being stacked in various orientations in large stacks at different locations, including within a truck. Such stacks sometimes reach a height greater than the height of the person doing the stacking, at which time the stacking of the next highest tray is done overhead and termed blind stacking. During blind stacking, it is very common to have various portions of the trays hang up by interfering engagement to provide excess forces or to stop the sliding. Such stopping or excess forces can become quite annoyinq to the operators, produce forces that would topple a stack of trays, and generally increase handling time.

These trays are used in great volume by large bakeries, distributors and retailers, so that small differences tend to take on large proportions when multiplied by the volume of trays in use. For example, a small annoyance or small delay in blind stacking becomes very large when repeated thousands of times, where there are tens or hundreds of thousands of trays within one distribution system.

In the parent application, bakery trays are provided with feet that ride upon rails, so that a top tray of a large stack may be inserted by placing its far bottom portion on the top rails of the adjacent front portion of the current tray at the top position and then sliding the top tray until it is in alignment, at which time feet of the top tray will become vertically aligned with recesses of the adjacent lower tray so that the two will interengage at some stacking position or interengage at a lower nesting position. The entire disclosure of application Ser. No. 274,500, filed Nov. 21, 1988, referred to above, is incorporated herein in its entirety.

In addition to the above described invention, there are many other bakery trays that will stack and nest and many other types of molded plastic containers as well as stacking and nesting containers in general, to which the present invention relates. Containers may interengage for purposes of nesting at a low level, stacking at a high level, or stacking at an intermediate level, and in such situations feet usually engage in some type of recess.

SUMMARY OF THE INVENTION

It is an object of the present invention to provide bakery trays having interengaging structure that permits blind stacking of one tray on another.

It is a further object of the present invention to improve the handling of bakery trays, wherein the bottom surface of the baking tray is involved.

It is another object of the invention to-increase the number of products that can be handled within one tray system by providing more than one series of trays within the system, wherein each series of trays can be interstacked with one another during use of the trays in transporting goods, but prevented from inter cross nesting with one another during return of the trays.

It is another object of the invention to increase the number of products that can be handled with one bakery tray system by providing more than one series of unitary molded plastic construction, with end walls and side walls to provide for 90 degree cross-nesting. The end walls of a first series of trays have interengaging feet and rails to provide for 180 degree oriented high stacking and like oriented low stacking. Another series of trays has interengaging feet and rails for either 180 degree oriented or like oriented stacking that is of the same height. The trays of the first and second series are interstackable. Accordingly, high and low stacking of one series of trays allows for the transporting of goods of two different product heights while interstacking of the first series of trays with another series of trays allows the transporting of additional goods of different product height.

Blind stacking of the trays of either series is provided by an additional outer rail at the upper end of each end wall of the tray and laterally extending outer feet at the bottom of each end wall for engaging the outer rail. Alternatively, interengaging structure is provided that includes a channel formed between an outer stacking rail and a guide rail at the upper end of each end wall and a plurality of feet along the lower part of the end wall that allows sliding engagement of the feet within the channel. Further, in one series of trays, the plurality of feet can be divided between outwardly spaced large feet and inwardly spaced small feet and cooperating outer and inner recesses that are sized to receive the large and small feet. The large and small recesses are aligned with the large and small feet in like orientation to provide low stacking of the series of trays. In 180 degree orientation, the feet and recesses are out of alignment so that the feet of an upper tray are stacked onto the channel of a lower tray to provide high stacking.

After transporting of the goods with the trays, cross-nesting is permitted by changing the orientation between upper and lower like series of trays by 90 degrees. Further, side wall-bottom wall interengaging structure is provided that prevents cross-nesting between trays of different series, even though trays of different series may be interstacked with one another by providing the appropriate end wall foot and recess structure.

According to one embodiment of the invention, it is an object of the invention to provide generally flat planar bottom surfaces of the trays that include chamfered or beveled edges. According to another embodiment of the invention, it is an object to provide stacking corner structure at the bottom of the trays and corresponding raised bottom wall construction that spaces the bottom wall of the trays off of the planar surface on which they are supported and provides rigidity at the corners of the tray to allow for stacking the trays in large numbers.

It is an object of the present invention to overcome disadvantages with with respect to all of the above described types of containers with respect to unstacking one or a plurality of containers from one or a plurality of adjacent lower containers, where there is some type of interengagement, referred to broadly with respect to interengaging feet of the upper container and recesses of the lower container.

To unstack this type of container, it is the usual practice to vertically pick up the upper container as a whole, to disengage the feet from the recesses, after which time the container may be further removed in an upward vertical direction, removed in a horizontal direction with a sliding motion, or removed at some angle therebetween, generally in a plane parallel with the side walls when the user is facing an end wall, although terms such as end wall and side wall are many times interchangeable. Of course, the upper container or containers may be removed in other planes and at other angles, but the above type of removal is usual.

While unstacking is awkward in general, and the present invention improves such unstackng, the present invention has particular advantage with respect to a problem wherein one or a plurality of trays has been blind stacked. Blind stacking refers to the situation wherein a user has lifted up one or a plurality of trays, particularly above his head, and rested the bottom portion of the bottom most tray at the far side, with respect to the user, upon the adjacent top of the top most tray of a high stack, and thereafter pushed the tray or trays that he is holding along the top tray of the stack until all the trays become properly aligned, which is usually when they are completely vertically aligned, at which time there may or may not be some interengagement between the trays to prevent their further horizontal relative movement and/or to permit the nesting of the trays to save space when they are empty, or the intermediate level stacking of the trays when there are small products within the trays. Blind stacking is advantageous because it is usually difficult or impossible to support the top tray or trays completely until they are vertically aligned with the top tray of the stack, because of the height of the stack or the side constraints of other stacks or a truck.

There is a particular problem in trying to unstack the top or a plurality of top trays from such a stack, because again it is difficult or impossible to bodily lift the entire top tray or group of top trays vertically upward until such time that they are disengaged from the adjacent top tray of the remaining stack. The present invention overcomes such a problem for trays or containers in general wherein this problem exists. Particularly, the top tray or plurality of top trays to be removed from such a stack are grasped at their near side by the user and lifted upwardly to disengage the feet and recesses at the near side, while the feet and recesses at the far side remain substantially completely engaged as the tray is tilted upwardly at an angle. At least the feet and recesses remaining engaged have lost motion in the horizontal direction sufficient to shift the lifted trays horizontally without disengaging the feet and recesses at the far side. In addition to the usual type of interengaging structure, the present invention provides a projection, preferably outwardly, from the midportion of each end of the trays that interengages with a generally vertically extending recess of the adjacent lower tray, which projection and recess become disengaged during the above mentioned angular lifting of the top tray or top trays. With the shifting horizontally of the angularly related trays, the projection will now be misaligned with its recess, because the projection and recess do not have lost motion to the extent provided by the end feet and recesses. At this time, the user can merely lower the near side of the tray or trays to be removed so that they will assume a horizontal position as the top tray or trays to be removed pivoted about an axis formed by the projection engaging a top surface, outside of the projection recess, of the top tray of the remaining stack. This is an advantageous way to unstack.

Recesses refer to any type of opening that can accommodate, in a generally telescopic manner, the feet or projections. The feet or projections may have the identical structure of each other, and are preferably cantilevered outwardly. The recesses may be blind recesses or through slots.

An additional advantage of the present invention resides in the provision of additional top structure wherein the projection may ride along such top structure, preferably a rail, so that the projection can support the entire weight of the tray or trays to be removed as such tray or trays to be removed are slid horizontally towards the user by the user merely pulling on the adjacent side, until the trays have moved sufficiently for the user to obtain a better grip on the trays so that they may thereafter be lifted up and removed vertically. When incorporated with the above identified application, the present invention is particularly advantageous in permitting such horizontal sliding movement of almost one-half the corresponding horizontal dimension of the trays, although a sliding motion of one-fourth or one-eighth, for example, of the length of the trays is still advantageous in providing the portion of the trays that can then be gripped by the user so that the trays may be easily lifted up vertically for unstacking and removal.

BRIEF DESCRIPTION OF THE DRAWINGS

Further objects, features and advantages of the present invention will become more clear from the following detailed description of the preferred embodiments, shown in the drawings, wherein.

DETAILED DESCRIPTION OF THE PREFERRED EMBODIMENTS

Two different height trays of two embodiments of the invention may be stacked with themselves or interstacked, with the larger size tray of a first embodiment being shown in FIGS. 1, 2, 4 and 7–15, and the smaller size tray of a second embodiment being shown in FIGS. 3, 5, 6 and 25. A third embodiment of the present invention is shown in FIGS. 20–24. A fourth embodiment of the present invention is shown in FIGS. 26–29. A fifth embodiment of the present invention is shown in FIGS. 30–40, and a sixth embodiment shown in FIGS. 41, 42. With respect to all the embodiments, like numerals have been provided for like parts wherein the descriptions herein are identical, with primes and additional numerals being added to show different tray constructions otherwise.

The unitary molded plastic tray of the present invention is used, for example, for storing and transporting bakery goods and the like. It is common for bakery trays to be nestable and stackable in different levels, for conserving space in transporting and storing bakery goods of different height.

Figure 1:
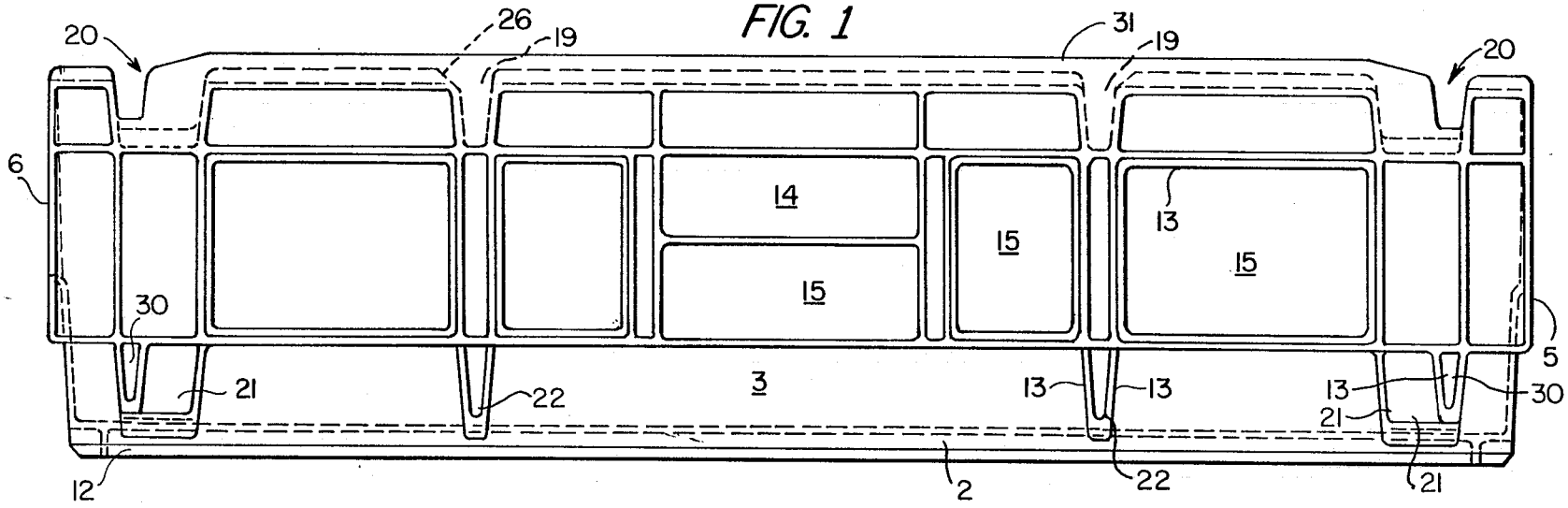
FIG. 1 is an elevational end wall view of a tray constructed according to a first embodiment of the present invention.
Figure 2:
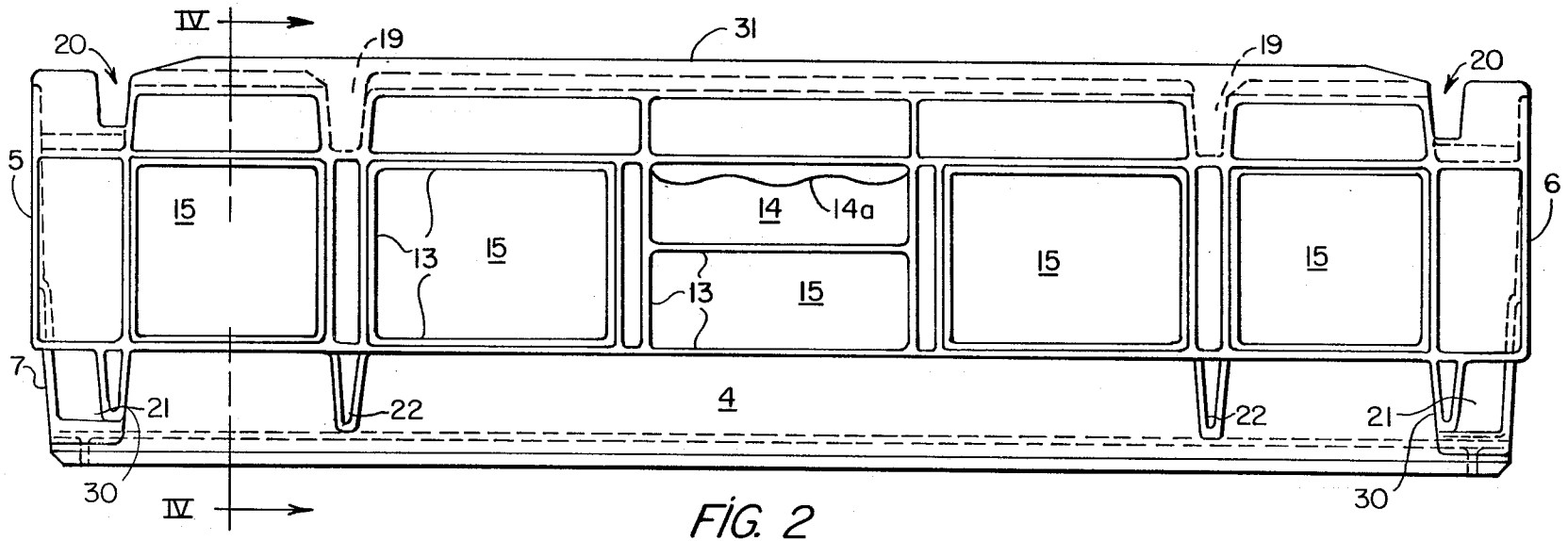
FIG. 2 is an elevational view of the opposite end wall of the tray according to FIG. 1.
Figure 6:
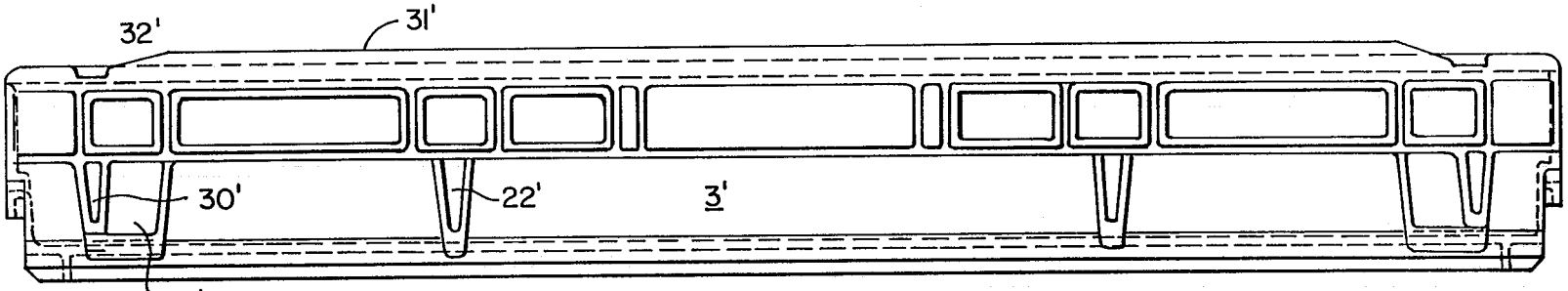
FIG. 6 is an elevational view of the opposite end wall of the tray according to FIG. 5, with the elevational side views of this tray being substantially the same, but of reduced size as that shown in FIG. 4 for the side walls.
Figure 4:
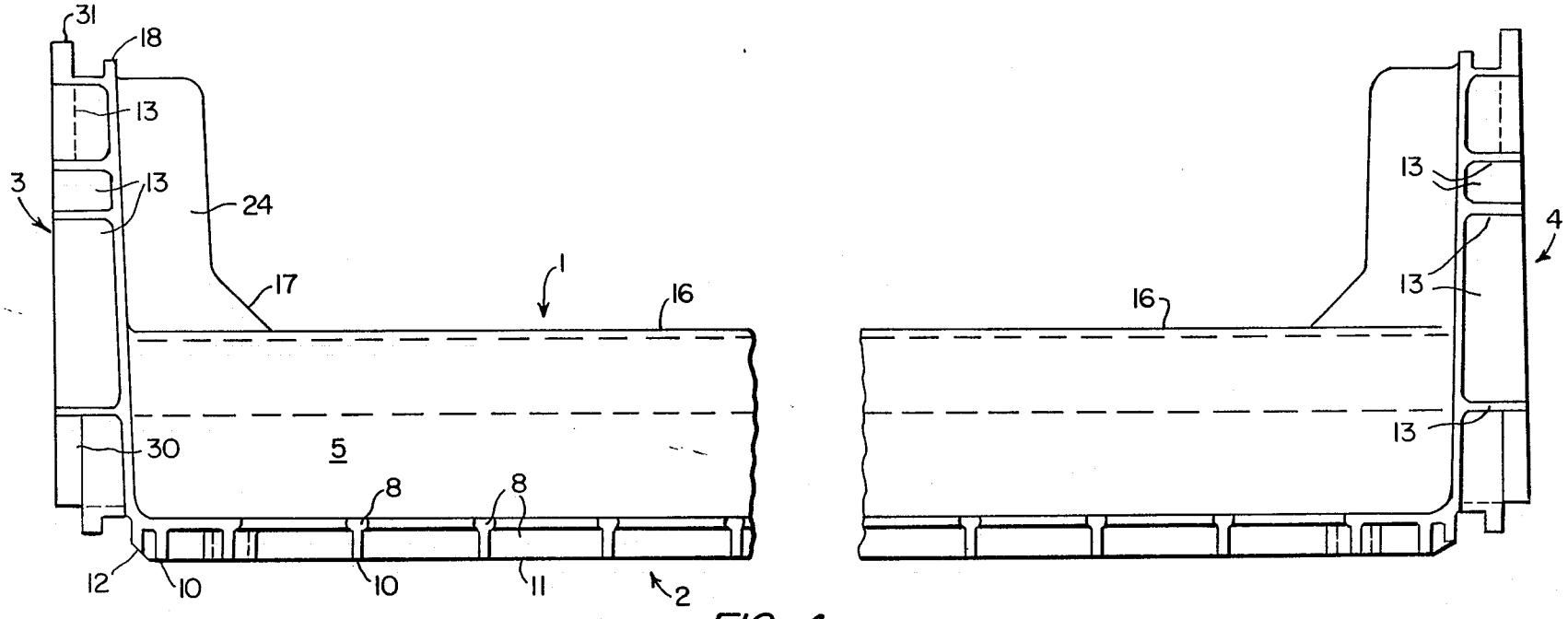
FIG. 4 is an elevational view, in cross-section, of one side of the tray according to the first embodiment, with the other side being identical.
Figure 5:
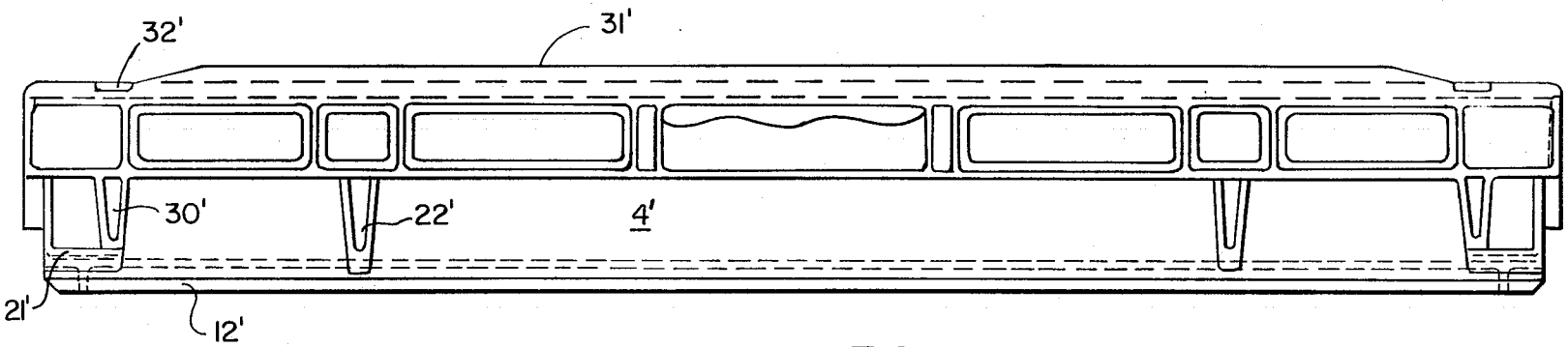
FIG. 5 is an elevational view of the end wall of a tray constructed according to the second embodiment employed alternatively with the different height trays of FIGS. 1–2.
Figure 15:
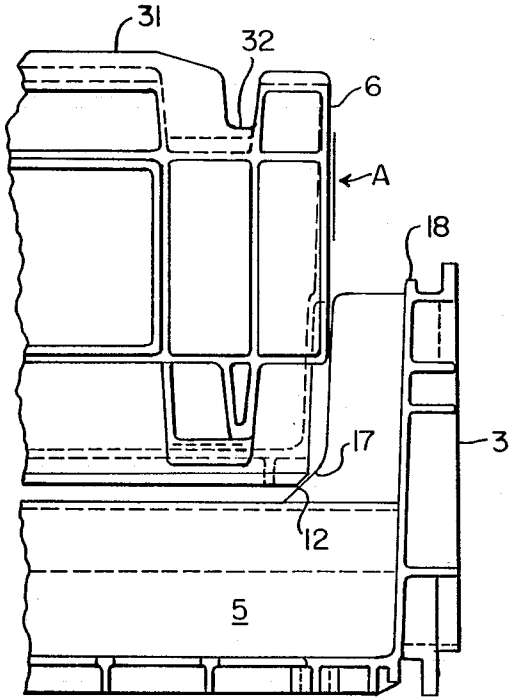
FIG. 15 is a partial view, taken in elevation from the side of the lower tray of two cross stacked trays in misaligned position.
Figure 14:
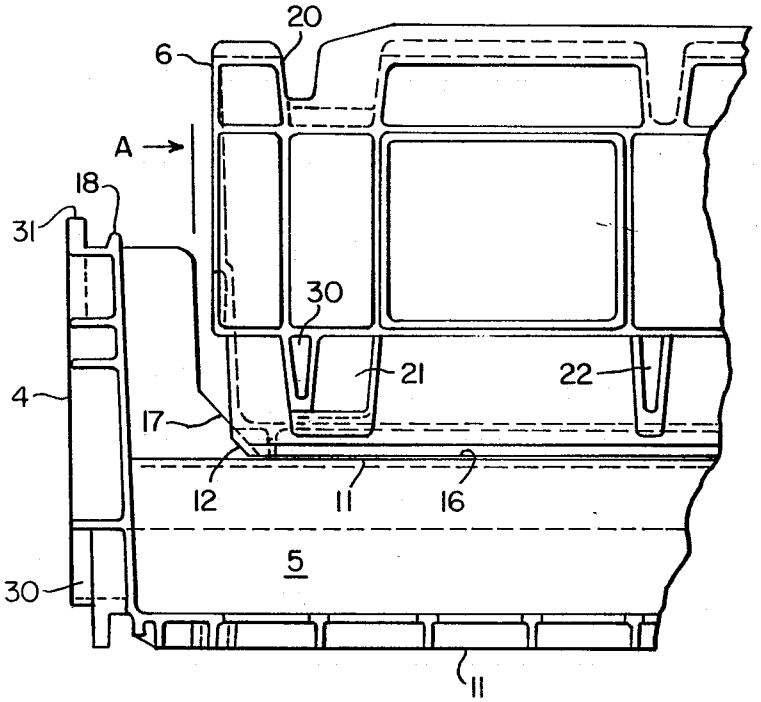
FIG. 14 is an elevational view of the side of a lower tray cross-nested with an upper tray in aligned position, with portions broken away.

The bakery tray of the first embodiment is shown in FIGS. 1, 2 and 4. The tray includes a generally rectangular bottom 2, a pair of opposed end walls 3, 4 and a pair of opposed side walls 5, 6. The walls are serially connected together at corners 7 around the perimeter of the bottom to produce an upwardly opening rectangular container or tray. As seen in FIG. 4, the end walls 3, 4 are higher than the side walls 5, 6, so that the trays may be stacked with adjacent like trays rotated in a 90 degree orientation with respect to each other, in a cross-nested relationship as shown in FIGS. 14 and 15. This type of structure is well known in the art.

The bottom structure is in the form of a grid, preferably a rectangular grid, of ribs 8 forming between them a plurality of at least similar small through passages 9 for aerating the bakery goods in trays and for providing lightness of the trays. As shown in the typical cross-sectional view of FIG. 4, the side walls 5, 6, the end walls 3, 4 and the ribs 8 all extend downwardly to terminal edges 10 that are coplanar to form a generally parallel horizontal bottom surface 11 interrupted substantially only by the through passages 9 and presenting the lowermost structure of the tray. This bottom planar structure of the terminal edges provides a tray support for providing abrasion resistance when sliding the tray and upper stacked trays that produce considerable weight on the lower tray along an abrading support surface. The abrading support surface could be a surface such as a concrete floor, which is rough and generally wears down plastic trays, particularly when the plastic trays of the prior art have a small support surface that is quickly worn down. With the tray of FIGS. 1–4, all of the terminal edges of the bottom surface 11 will be contacting the support surface, such as a floor. When the support surface is discontinuous, for example with a roller bed or a floor having a crack, conventional trays have hung up on such a discontinuous surface because of their discontinuous bottom, which might result in jamming of automatic conveying equipment or breaking off of edges, for example when a large stack of trays is pushed across a floor having a crack. According to several embodiments of the present invention, the tray is provided with the substantially planar support surface 11 that will not have such problems when encountering abrading and discontinuous support surfaces as are commonly provided during normal handling of such trays. This function of the tray support bottom surface is provided in all horizontal directions of relative movement between the tray and the support surface such as a conveyor or floor.

Chamfers 12 are provided along the entire edge perimeter of the bottom 2, so that the forks of a fork lift truck or the like moving along a support surface such as a floor may engage the bottommost tray of a stack of trays, more specifically engage the fork with the chamfer, to lift the bottommost tray upwardly and over the forks so that thereafter the forks may engage the generally planar horizontal bottom surface 11 of the bottommost tray that otherwise would be engaged in the support surface. In this manner, the chamfer 12 provides a ramp extending upwardly and outwardly from at least the terminal edge of the walls 3, 4, 5, 6 and more specifically around the entire perimeter of the bottom. In addition, these chamfers 12 will assist in moving the trays, particularly with automatic conveying equipment, across a discontinuous surface, such as a roller or wheel conveyor. Further, these chamfers 12 will assist when moving the trays across a discontinuous surface, such as a floor having an upraised crack portion that will engage the chamfer surface 12, without any abrupt stoppage that in the past has broken conventional trays. Also, the chamfer surface 12 is important in preventing engagement with upraised cracks or the like in the floor that might stop the lowermost tray and cause the upper trays of a large stack to continue going forward to thereby upset the entire stack, which can produce considerable problems with respect to ruining bakery products and further breaking additional trays, in addition to providing increased labor time.

In the known manner of such trays, the walls are provided with outwardly extending reinforcing ribs 13, for example as seen in FIG. 2, which define a handle area 14, and open areas 15. To enable a person handling the trays by the handles to recognize like and 180 degree orientation by feel rather than by sight, handles 14 at one end wall 4 are provided with finger indentations **14*a***.

Returning to the cross-nesting feature as shown in FIGS. 14 and 15, it is seen that the interior distance between end walls and more particularly between points A, is substantially greater than the exterior distance between the side walls 5 and 6 so that the trays may be cross-nested, with 90 degree orientation between adjacent trays. This is accomplished by having the alternate trays of the vertical stack rotated about a vertical axis 90 degrees with respect to each other.

Figure 25:
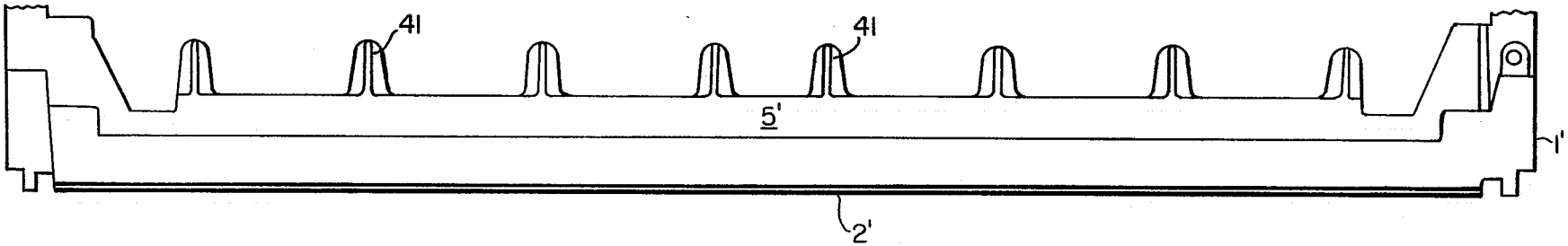
FIG. 25 is a partial elevational view, in cross-section, of one side of the tray constructed according to the second embodiment of the invention, with the other side being identical.

According to the first embodiment, the side walls 5 and 6 have a substantially linear continuous central top most edge 16 corresponding in length to the side to side width of the bottom surface 11 as measured parallel to the end walls 3, 4, for smoothly and continuously engaging the bottom of an upper tray with the near top most edge 16 during cross-nesting and thereby providing relative free sliding between the trays. In other embodiments, the side walls have product retention fingers, for example as shown in FIG. 25, that extend through the grid of the bottom of an adjacent upper tray during cross-nesting, to be explained in further detail hereinafter with respect to the second and third embodiments of the invention.

Each of the side walls 5, 6 is provided with a buttress portion 17 extending from opposite ends of the top most edge 16 upwardly and outwardly toward the higher end walls 3, 4, respectively. The buttresses portions 17 are at a spacing and orientation for engaging the ramps or chamfers 12 of an upper cross-nested tray, during nesting, as shown in FIGS. 14 and 15, to guide the trays relative to each other in the horizontal direction parallel to the side walls 5, 6 of the lower tray to an aligned position shown in FIG. 14 from a misaligned position shown in FIG. 15. This engagement between the buttress portions 17 and chamfers 12 facilitates aligned cross nesting and initially provides for offcenter room for quick cross-nesting and automatic alignment thereafter. This feature greatly facilitates automated handling, such as with automated assembly lines for cross-nesting the trays without the intervention of humans. Such misalignment and automatic alignment by the surfaces 12, 17, which are at complementary angles, provides considerable tolerances and is necessary for reliable machine cross-nesting in automated equipment.

It is to be understood that all of the above described cross-nesting structure could also be provided in the lower height end wall trays shown in FIGS. 3, 5, 6 and 25. However, the sidewall structure and cross-nesting of these trays is different, as shown, for purposes of illustrating another feature of an embodiment of the present invention.

Figure 7:
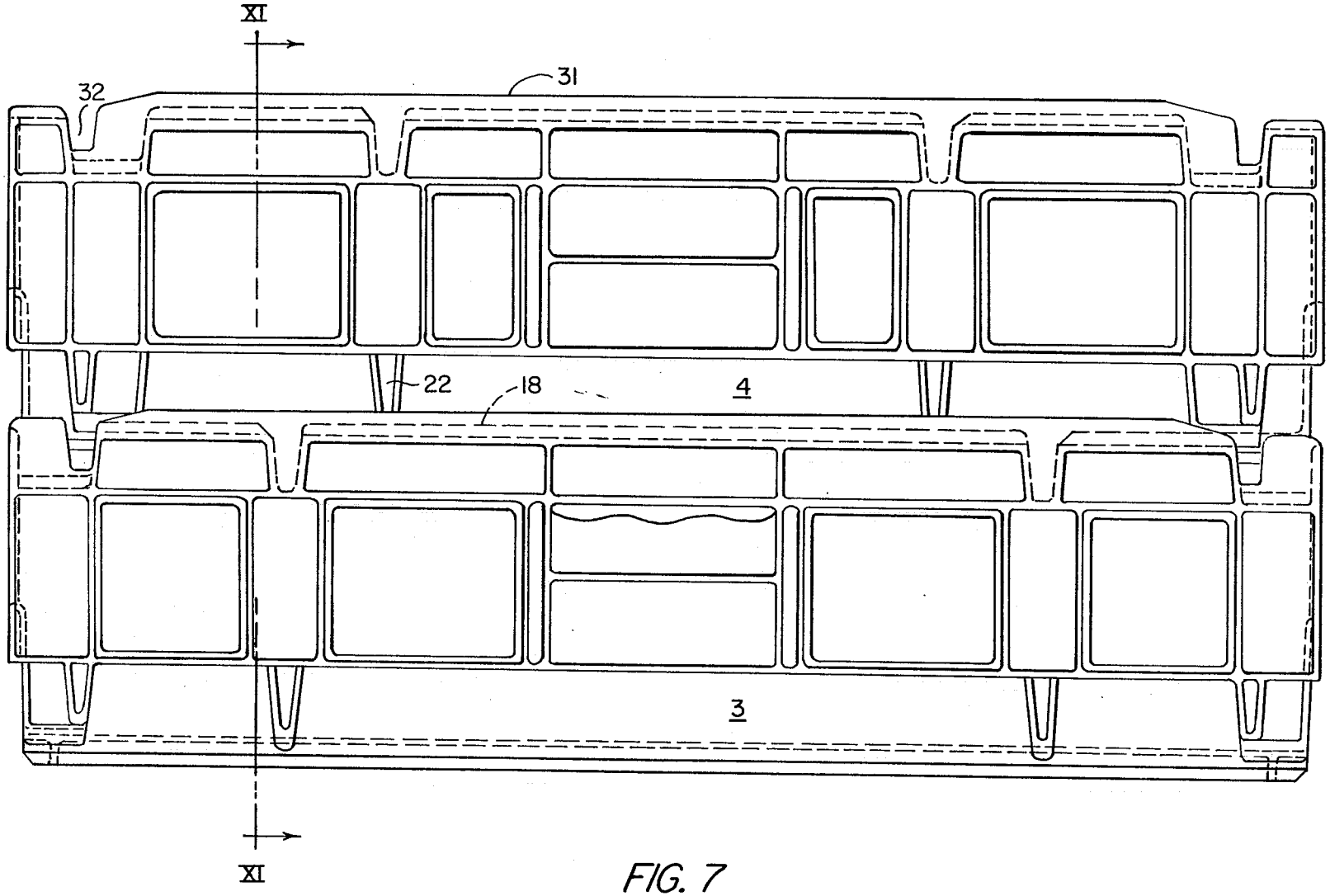
FIG. 7 is an elevational view of the ends of two like trays constructed according to the first embodiment stacked in a 180 degree oriented high position.
Figure 8:
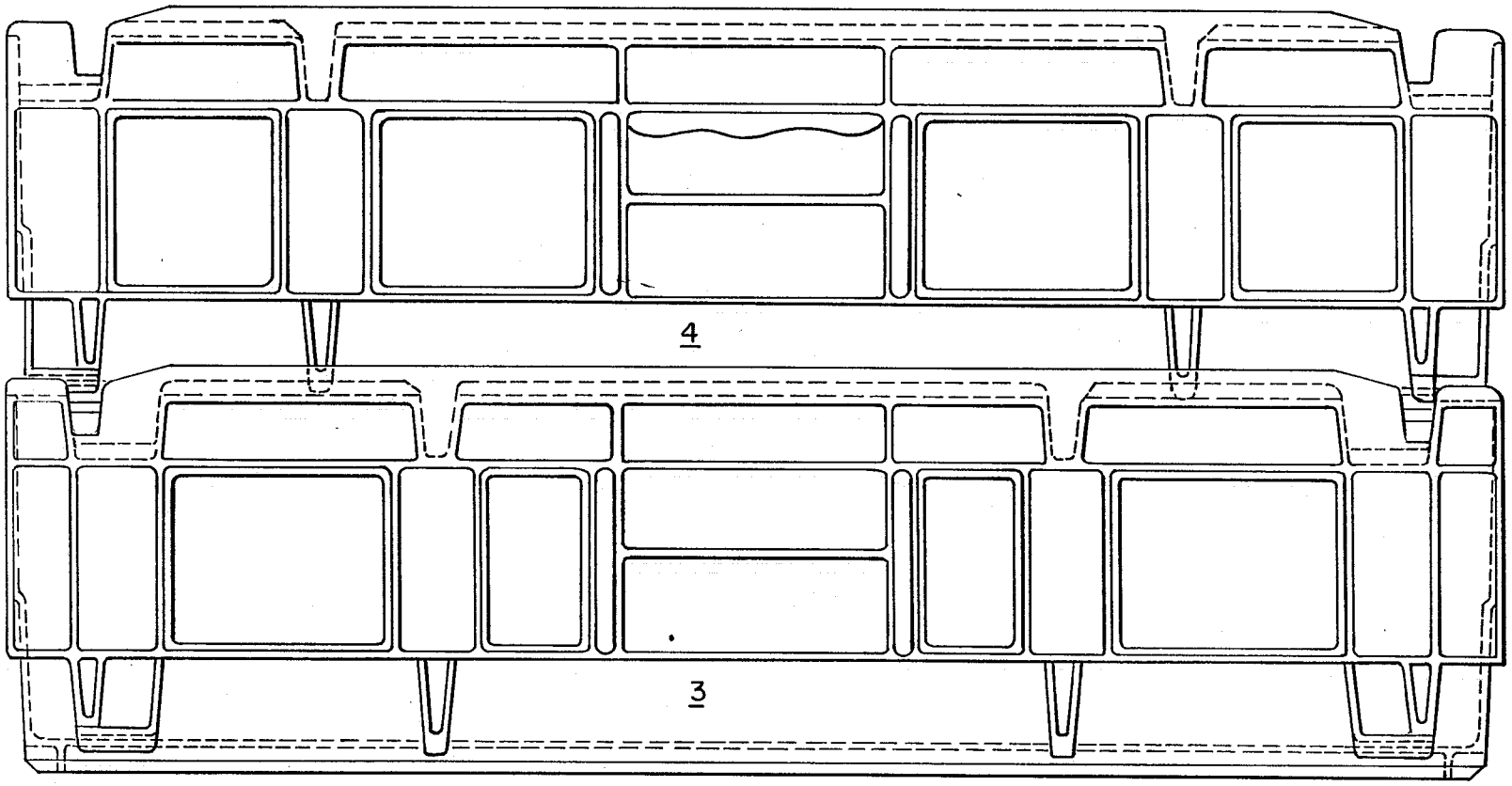
FIG. 8 is an elevational view of the other ends of the stacked trays according to FIG. 7.
Figure 9:
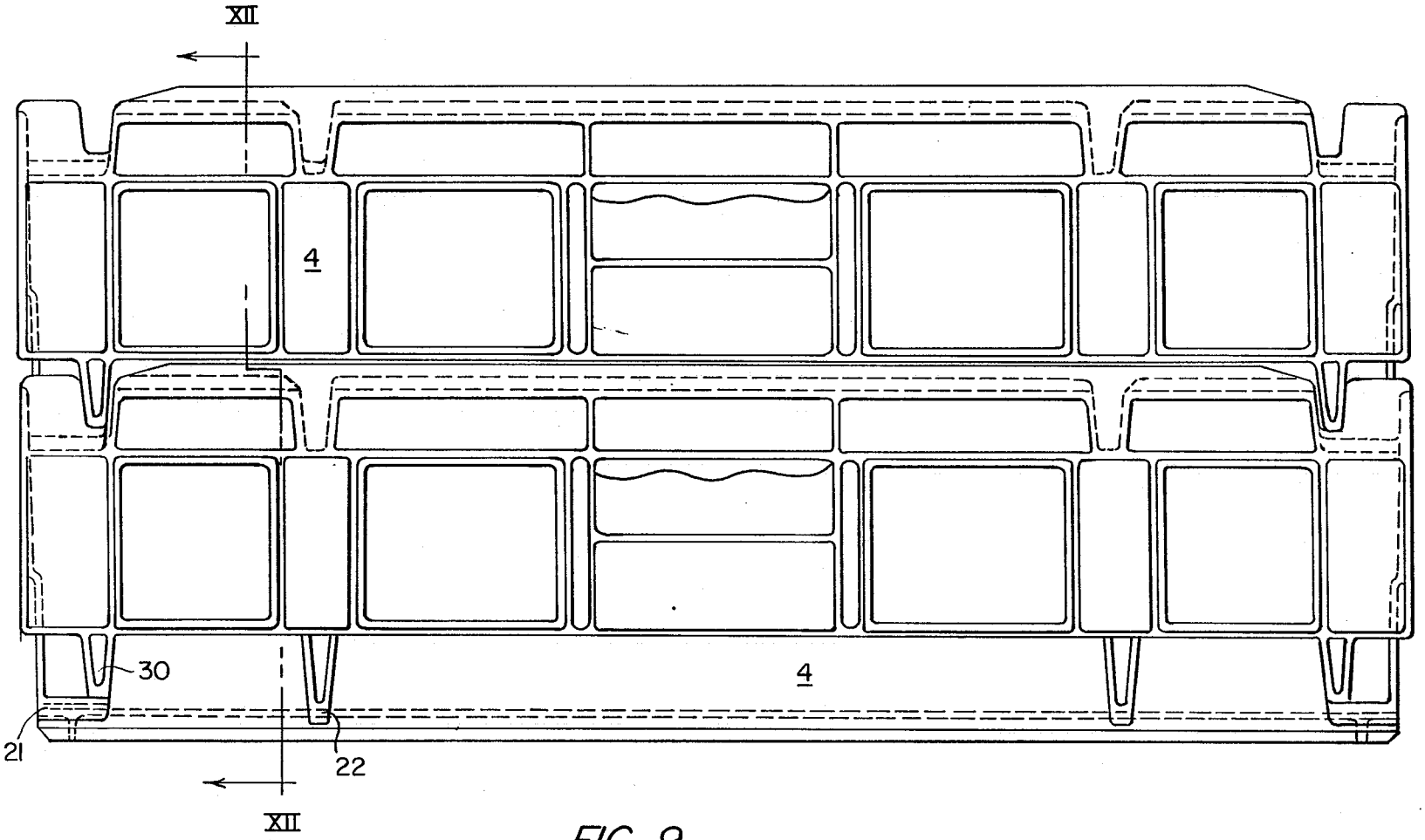
FIG. 9 is an elevational view of the ends of two like oriented trays stacked in a low or intermediate position.
Figure 10:
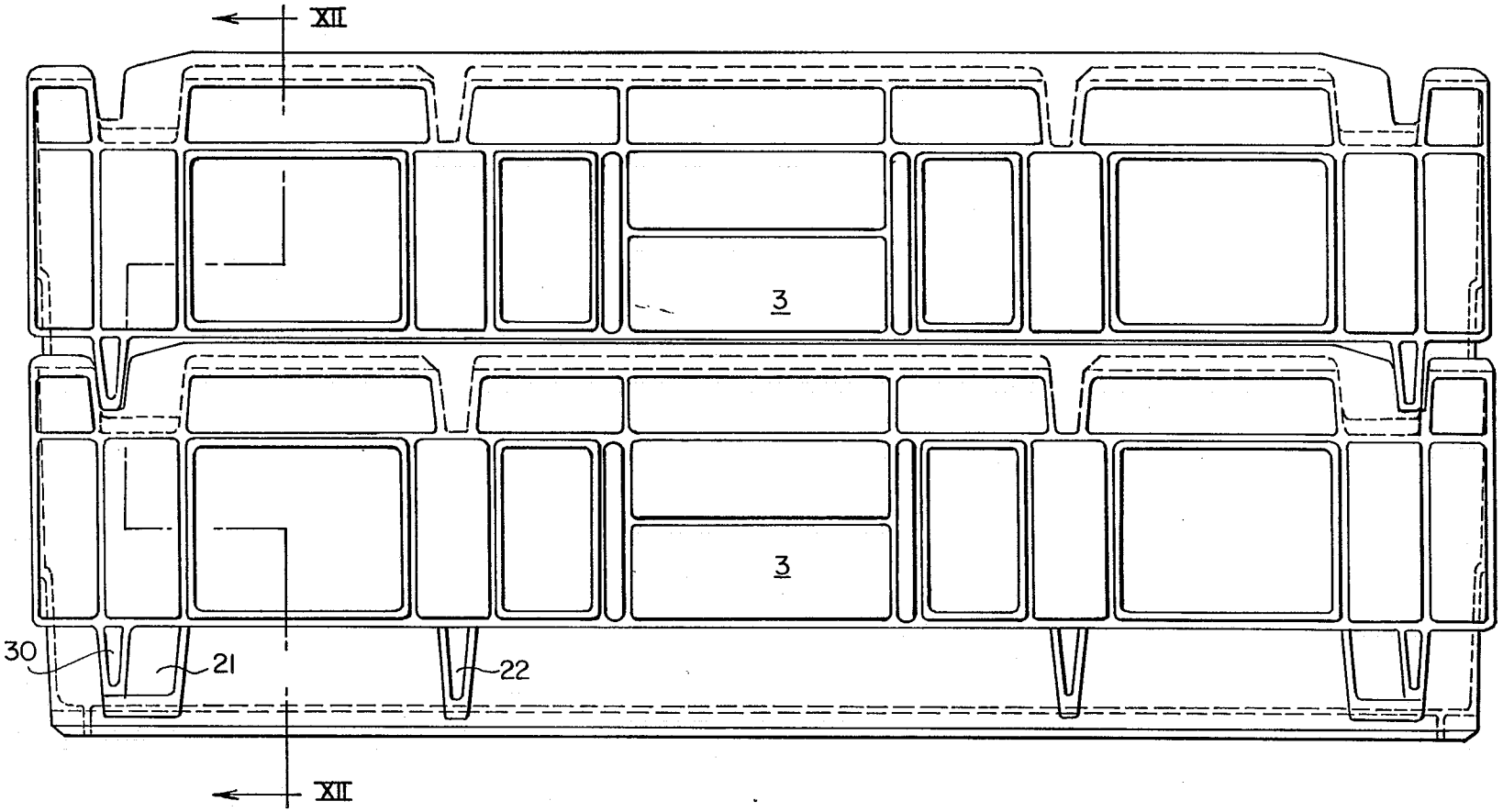
FIG. 10 is an elevational view of the opposite end of the stacked trays according to FIG. 9.
Figure 11:
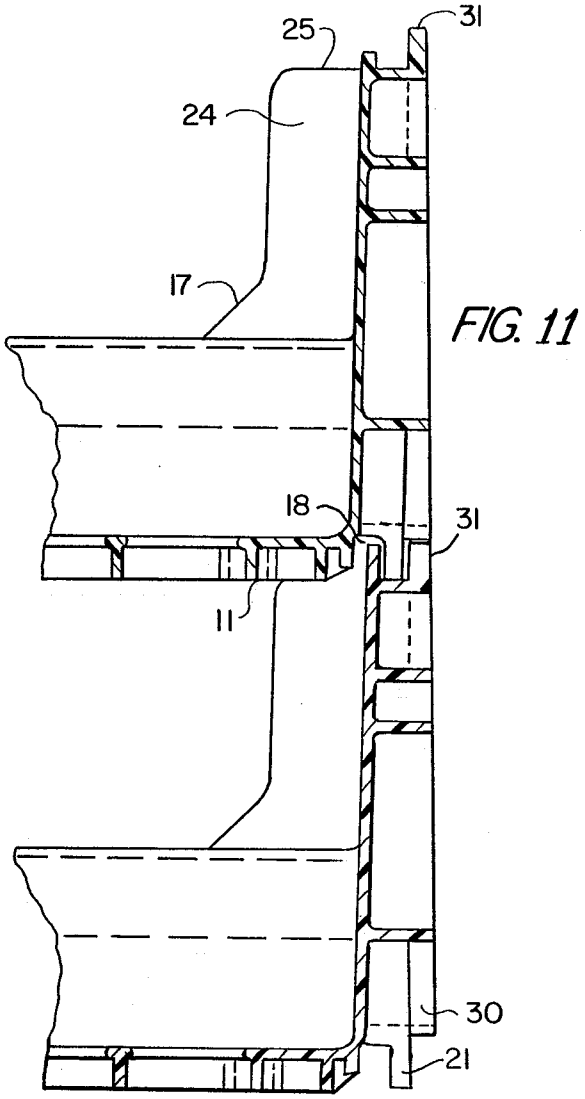
FIG. 11 is a partial cross-sectional view, in side elevation, of the trays stacked according to FIGS. 7 and 8, as taken along line XI—XI in FIG. 7.
Figure 12:
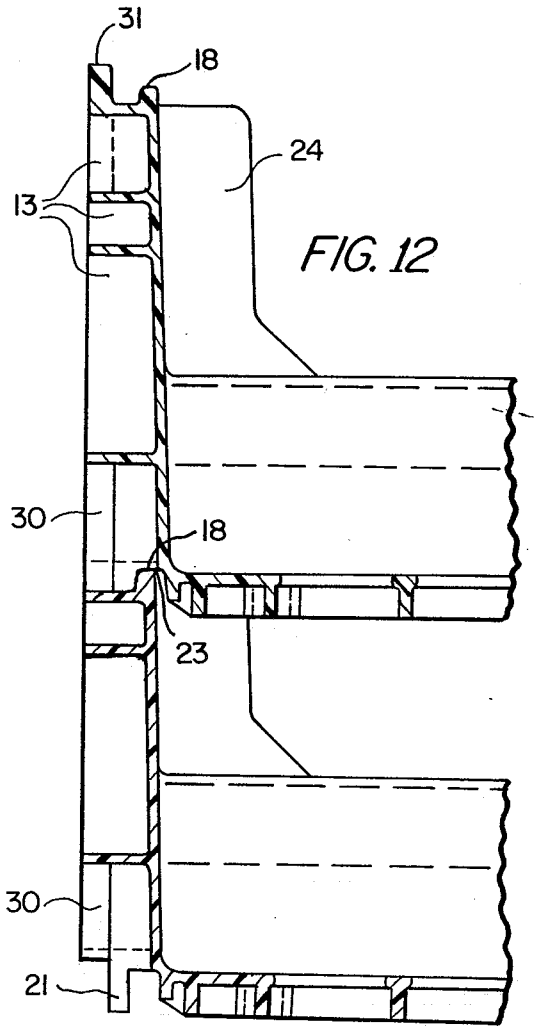
FIG. 12 is a partial cross-sectional view, in side elevation, of the trays being blind stacked according to FIGS. 9 and 10, as taken along line XII—XII in FIG. 9.

For the trays shown in FIGS. 1, 2 and 4, there is interengaging structure to provide for like oriented stacking of like trays at a low level or at an intermediate level if the cross-nesting is considered to be a low level. This like orientation is shown in FIGS. 10 and 12. Like trays may also be stacked in 180 degree orientation, that is rotated about a vertical axis 180 degrees with respect to adjacent trays stacked to produce high level stacking as shown in FIGS. 7, 8 and 11. The high level stacking, as is known, provides for the storage and transportation of high bakery products such as bread, the low or intermediate stacking provides for intermediate height products such as buns, and cross nesting facilitates the transporting of empty trays or storage and transportation of very low level products.

The interengaging structure of the trays of the first embodiment comprises an inside rail 18 and an outer stacking rail 31 along on the upper portion of each of the end walls 3, 4. Rails 18 and 31 form a channel 28 having a channel bottom 28*a*. Inside rail 18 functions as a guide rail along each of the end walls 3, 4. Rail 18 is provided with a pattern of at least two small recesses 19 and at least two large recesses 20 extending downwardly. The pattern of recesses in one rail 18, on end wall 3 is different from the pattern of recesses in the other rail 18, on the end wall 4, so that with 180 degree oriented stacked trays, as shown in FIGS. 7 and 8, vertically adjacent small recesses of adjacent trays will be misaligned vertically for each end wall of adjacent trays and vertically adjacent large recesses of adjacent trays will be misaligned vertically. The interengaging structure further includes a pattern of at least two large feet 21 and at least two small feet 22 along the bottom of each of the end walls 3, 4. The pattern of feet 21, 22 on one end wall 3 is different from the pattern of feet 21, 22 on the other end wall 4. This difference in foot pattern is such that with 180 degree oriented like stacked trays, vertically adjacent large feet will be vertically misaligned and vertically adjacent small feet will be vertically misaligned with at least some of the feet engaging the channel bottom 28*a* to provide the high position. In the like oriented position of two stacked like trays shown in FIGS. 8 and 10, the large feet of the upper tray will be received within the large recesses of the lower tray and the small feet of the upper tray will be received within the small recesses of the lower tray to provide a low stacked position. In the positions shown in FIGS. 7, 8, 9 and 10, it is seen that for each end wall 3, 4, all of the large and small feet are coplanar with each other and coplanar with all of the large and small recesses.

The blind stacking of the trays according to the present invention is achieved by a blind stacking structure according to different embodiments of the invention. The preferred blind stacking structure includes the large feet and additional outer stacking guide feet structure, wherein the guide feet engage the stacking rail to guide an upper tray across the end walls of a lower tray. Alternatively, as shown in FIGS. 26–29, the blind stacking structure can include only the large and small feet 21''' and 22''' respectively in cooperation with the large and small recesses without the need for additional outboard stacking structure.

The outboard blind stacking structure will now be described generally, with reference to the first embodiment specifically. Guide feet 30 are provided at opposite ends of each of the end walls 3, 4, adjacent the bottom. As seen, for example in FIG. 12, the guide feet 30 are outwardly spaced from and separate from the interengaging structure. The stacking rails 31 have recesses 32 at the opposite ends of the end walls 3, 4, which recesses 32 are vertically aligned with the guide feet 30 and correspondingly shaped to receive the guide feet 30 of a similarly constructed or like constructed tray. The reception of the guide feet 30 within the guide recesses 32 is to a nesting depth of like containers sufficiently for the above-described interengaging structure to provide each of the high and intermediate or alternately stated high and low positions of 180 degree orientation and like orientation of adjacent stacked like containers. The stacking rails 31 between the guide recesses 32 are linear, flat along their upper surface, and preferably horizontal, of continuous height and constructed to receive and support thereon the guide feet 30, as shown in FIG. 11, of an upper container during blind stacking at the far side and even the near side. Engagement of the guide feet 30 with the stacking rail 31 maintains like oriented and 180 degree oriented like containers vertically spaced at a height greater than the above-mentioned high level stacking and thereby greater than the above-mentioned low and intermediate stacking height. Therefore, with blind stacking of like containers, the guide feet 30 engage the guide rail 31 slidably along the entire length of the guide rail 31 to maintain the interengaging structure spaced from each other and maintain the interengaging structure inoperative until the guide feet 30 align with and interengage or nest with the guide recesses 32, at which time, the interengaging structure can provide the high and low stacking.

All of the blind stacking features described above are equally attainable with the low level trays of FIGS. 3, 5, 6 and 25, wherein like structure is provided with like numerals. Of course, since the high level is not provided with the low trays of this second embodiment, the inner guide rail 18, is not provided with recesses, thus eliminating intermediate and high level stacking. The above-mentioned blind stacking features have related to the forwardmost edge of the top container. There are also blind stacking features relating to the rearwardmost portion of the lower container that engages the bottom of the upper container. With specific reference to FIG. 11, the buttress portions 17 are connected to high wall portions 24 of the side walls that have top planar surfaces 25 for engaging the planar bottom surface 11 of a like top tray at the near end, with respect to an operator conducting blind stacking, of like oriented and 180 degree oriented trays. Engagement between the top edge 25 and the bottom surface 11 of adjacent trays during blind stacking at the near portion to the operator occurs linearly and smoothly without interruption throughout the entire blind stacking process coincident with the blind stacking process described above. That is, the surface 25 provides linear sliding engagement continuously during blind stacking to support the near portions of like containers while the far portions of like containers are supported with respect to each other by the guide feet traveling upon the stacking rail 31.

Figure 13:
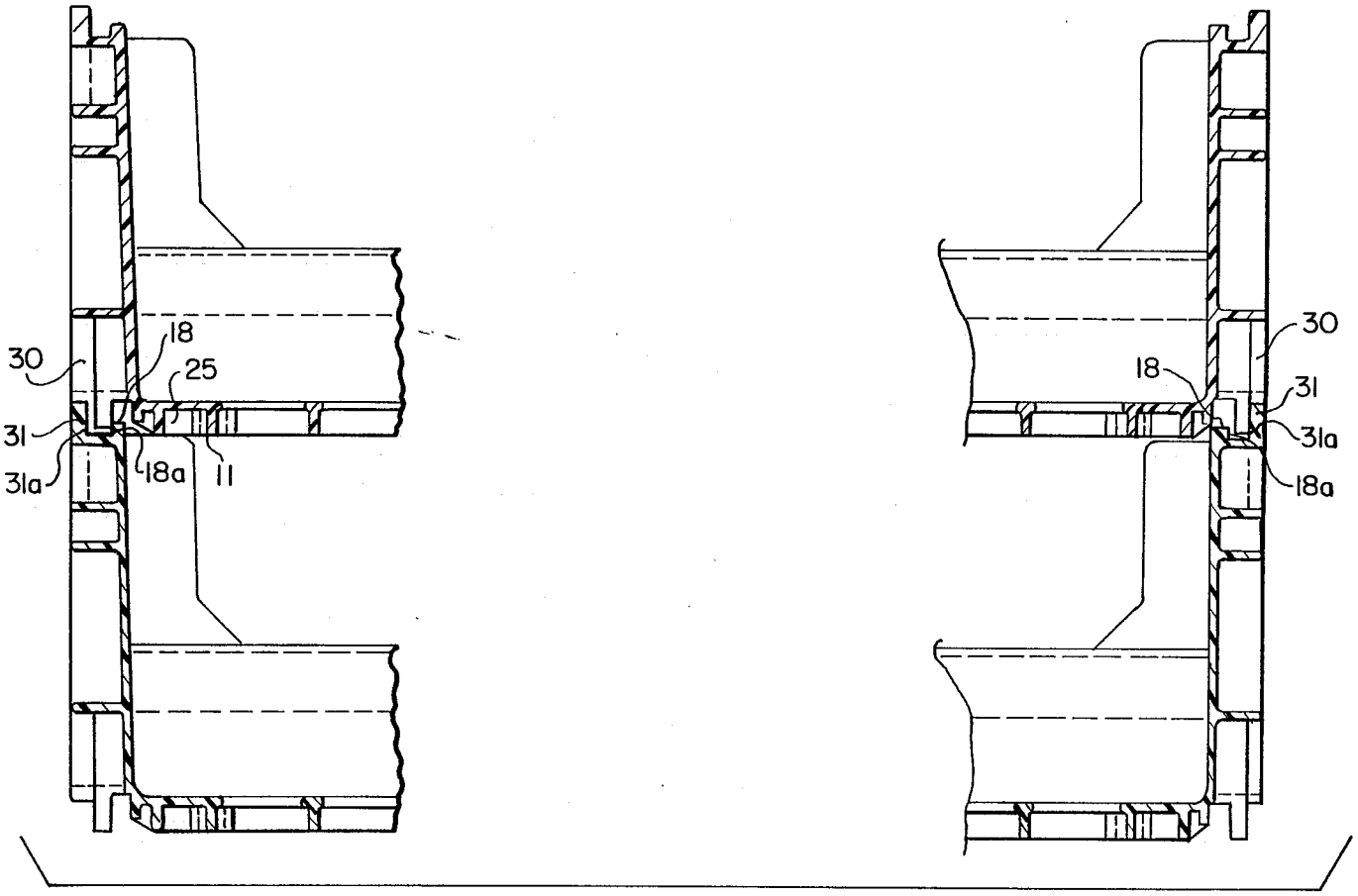
FIG. 13 is a cross-sectional view, with the center portion broken away, taken along line XIII—XIII in FIG. 16, blind stacking being shown.

According to another feature of the blind stacking of the trays constructed according to the present invention, the large feet 21 extend downwardly into the channel formed between an inner wall 31*a* of stacking rail 31 and an outer wall 18*a* of guide rail 18. This feature is in all of the embodiments, but is best shown with respect to the embodiment shown in FIGS. 13, and 16–19 wherein the feet 21 flush to the bottom of the tray such that the second embodiment of the tray disclosed by these figures is modified from the first embodiment. As shown in FIG. 13, the bottom 23 of the large feet 21 extend into the channel but do not touch the bottom surface 28 of the channel so that increased sliding resistance during blind stacking is prevented. It is preferred that the large feet extend into the channel to resist lateral movement of an upper tray being blind stacked onto a lower tray by confining the movement of the bottom portion of the foot within each of rails 18 and 31.

Figure 16:
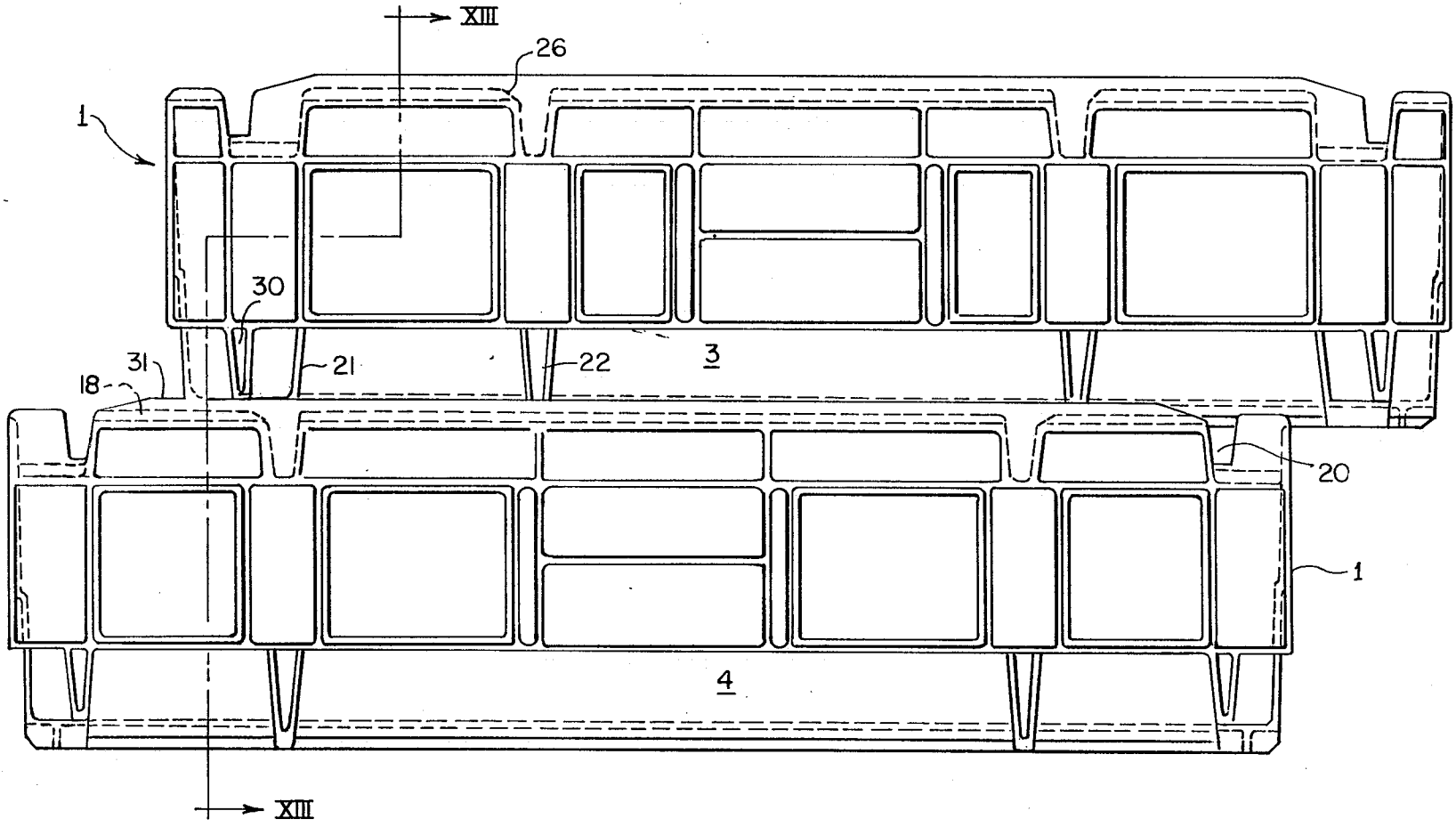
FIG. 16 is an elevational view of the ends of two 180 degree oriented trays constructed according to a modification of the first embodiment sliding along each other during blind stacking.
Figure 17:
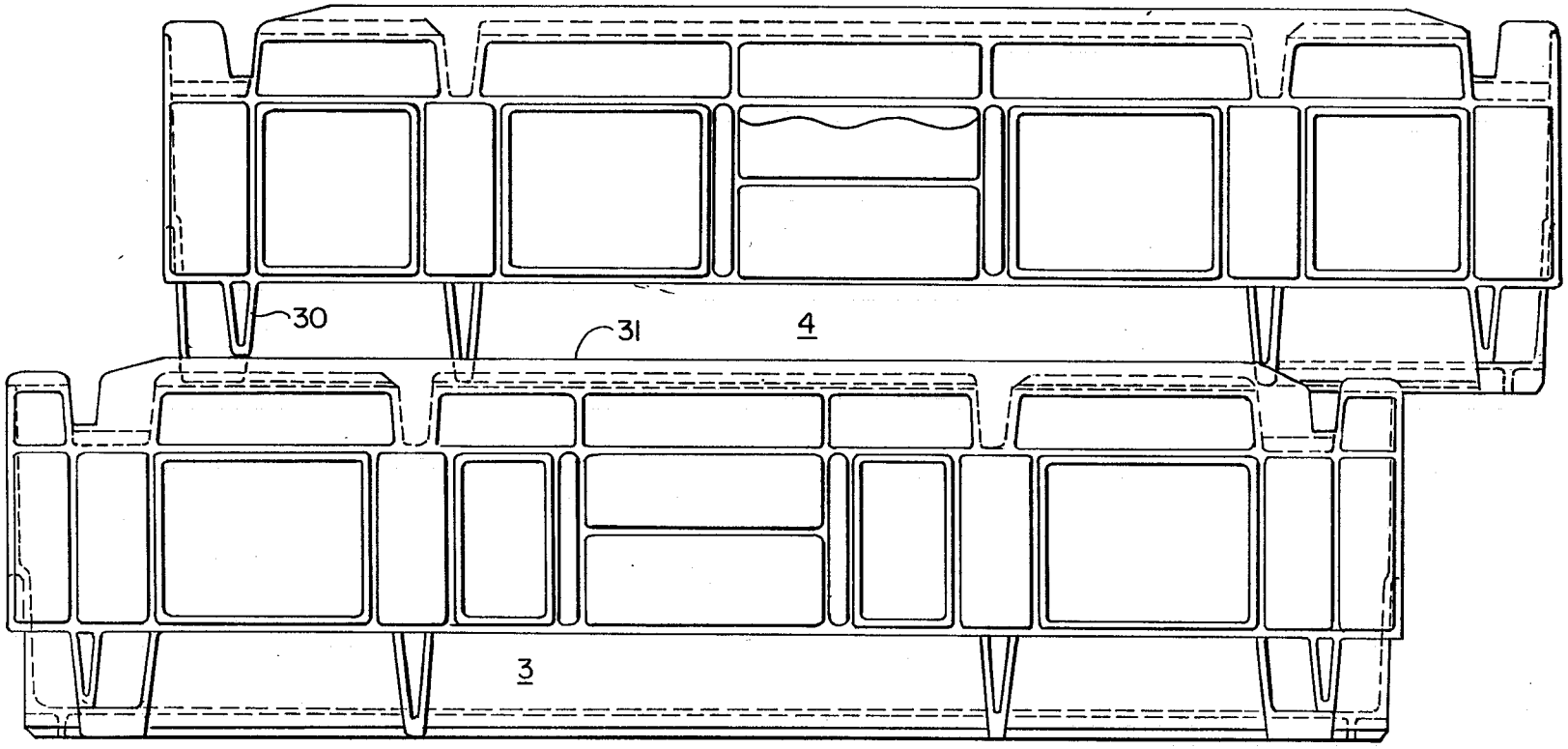
FIG. 17 is the opposite end elevational view of the blind stacking of trays shown in FIG. 16.
Figure 18:
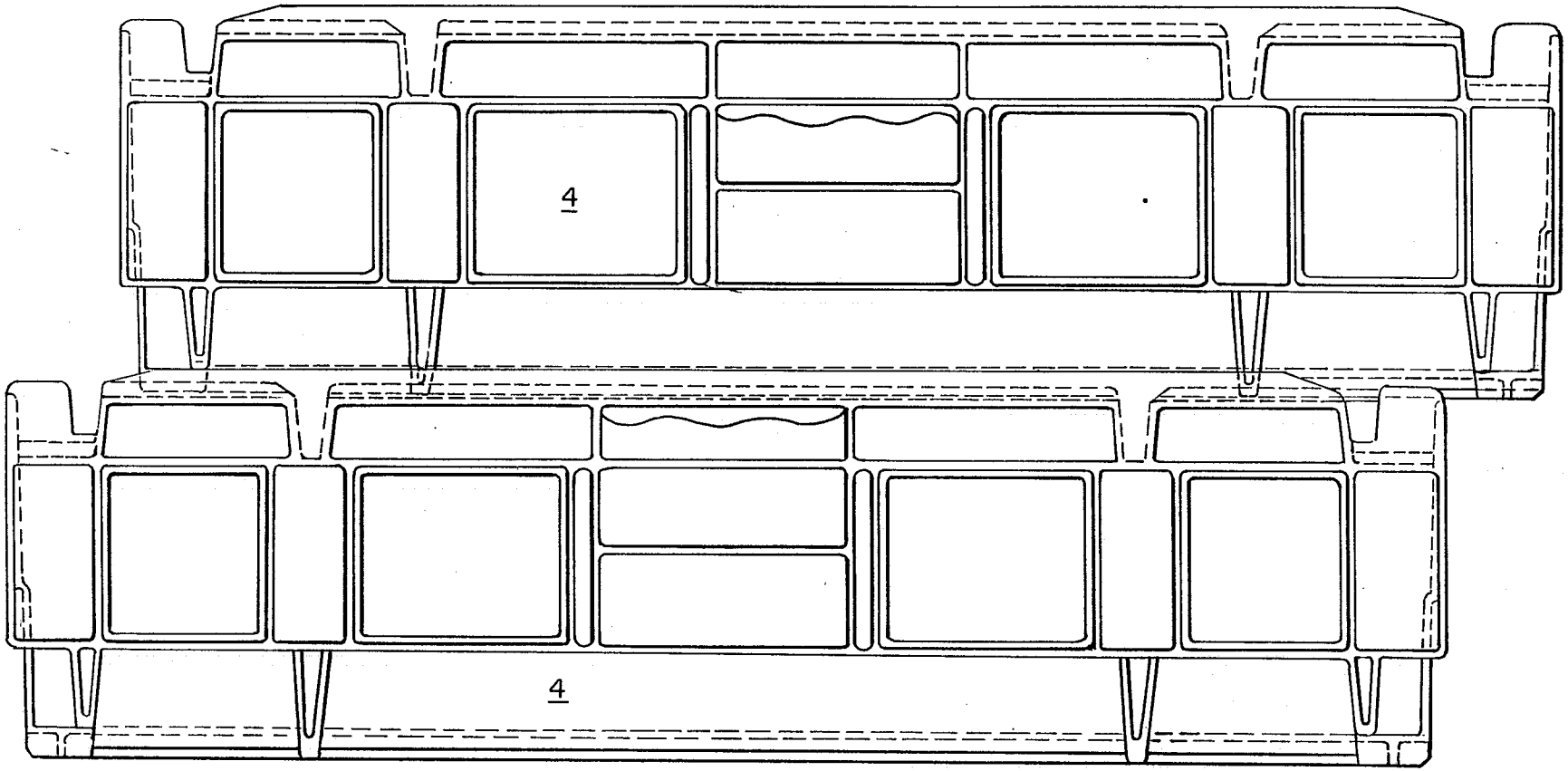
FIG. 18 is an end elevational view of like oriented trays constructed according to the modified embodiment of FIG. 16 being blind stacked.
Figure 19:
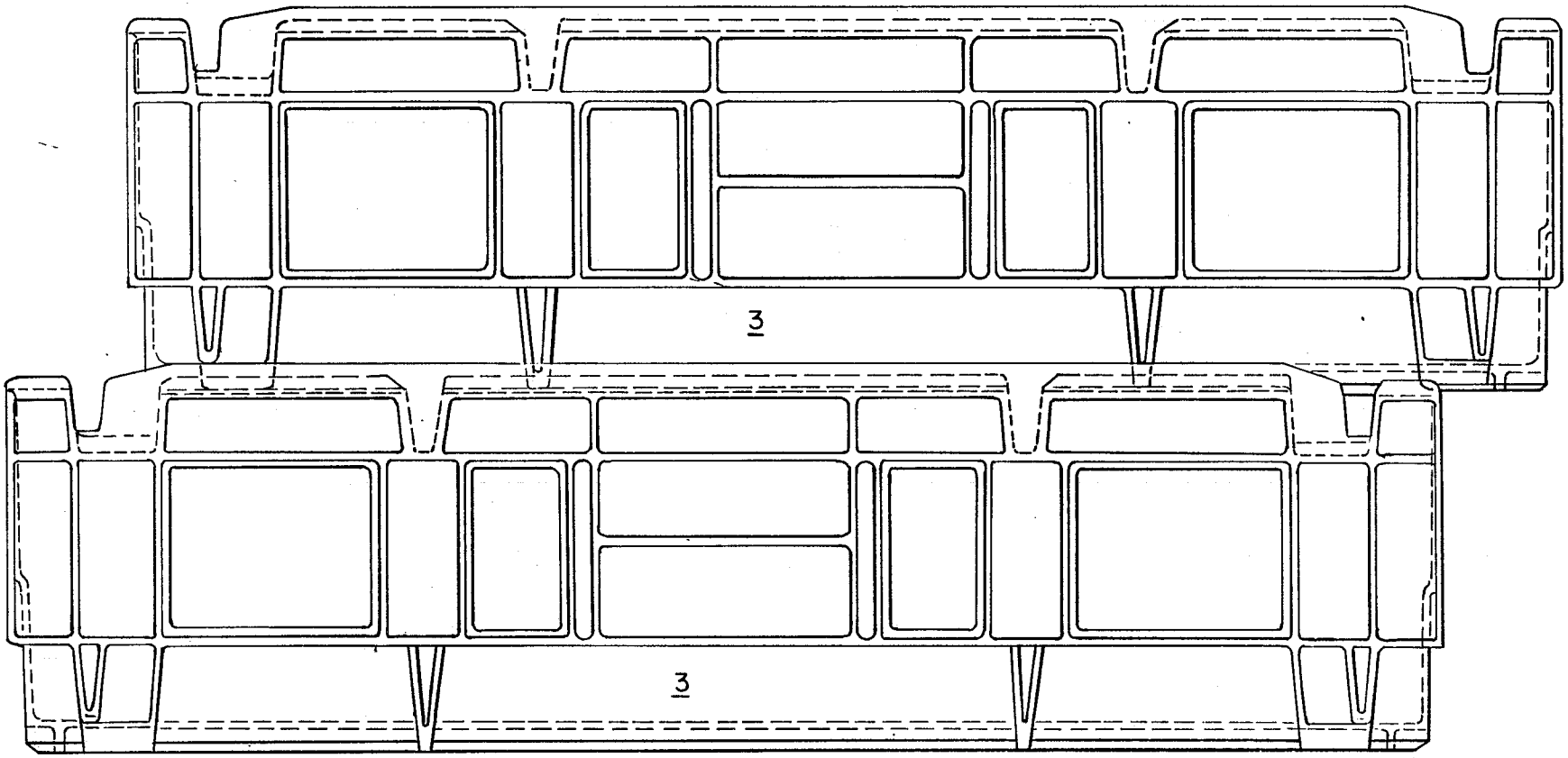
FIG. 19 is an elevational view of the other end of blind stacking of trays shown in FIG. 18.
Figure 20:
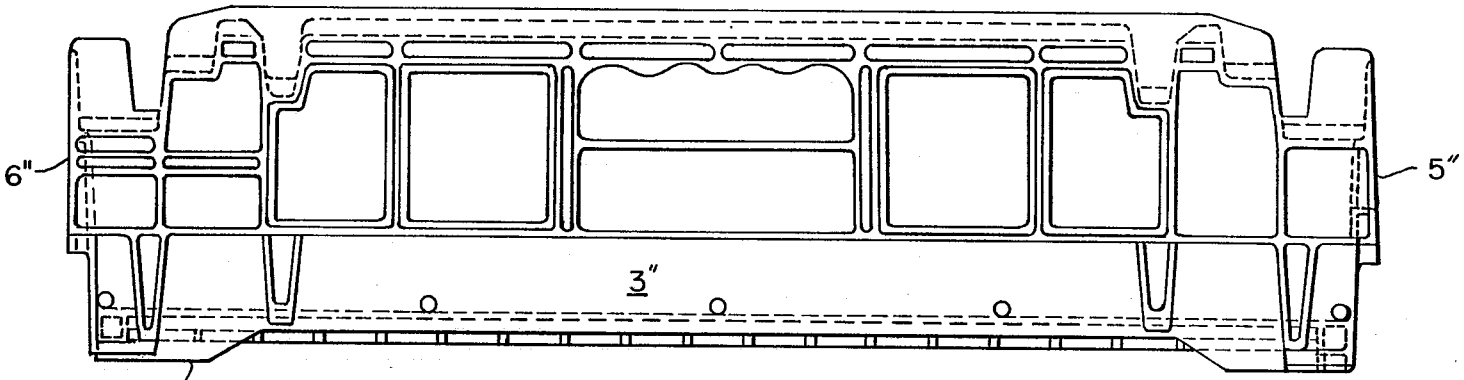
FIG. 20 is one end elevational view of a tray, according to the present invention, showing a third embodiment.

To further aid in blind stacking the trays of each of the embodiments constructed according to the invention, the small recesses have a tapered wall portion 26 that guides the leading edge of an upper tray out of engagement with the small recesses as the step of blind stacking an upper tray on a lower tray is nearly completed. As shown in FIG. 16, the trays being blind stacked on one another are nearly parallel at the forward edge of the upper tray as it crosses the small recess, so engagement of the forward edge of the upper tray with the small recess is unlikely. However, should the trailing edge of the upper tray be lifted in relation to the lower tray, then the tapered wall portion 26 would guide the front edge smoothly over the opening of the small recess to enhance the free sliding movement during blind stacking of the upper tray onto the lower one.

Figure 21:
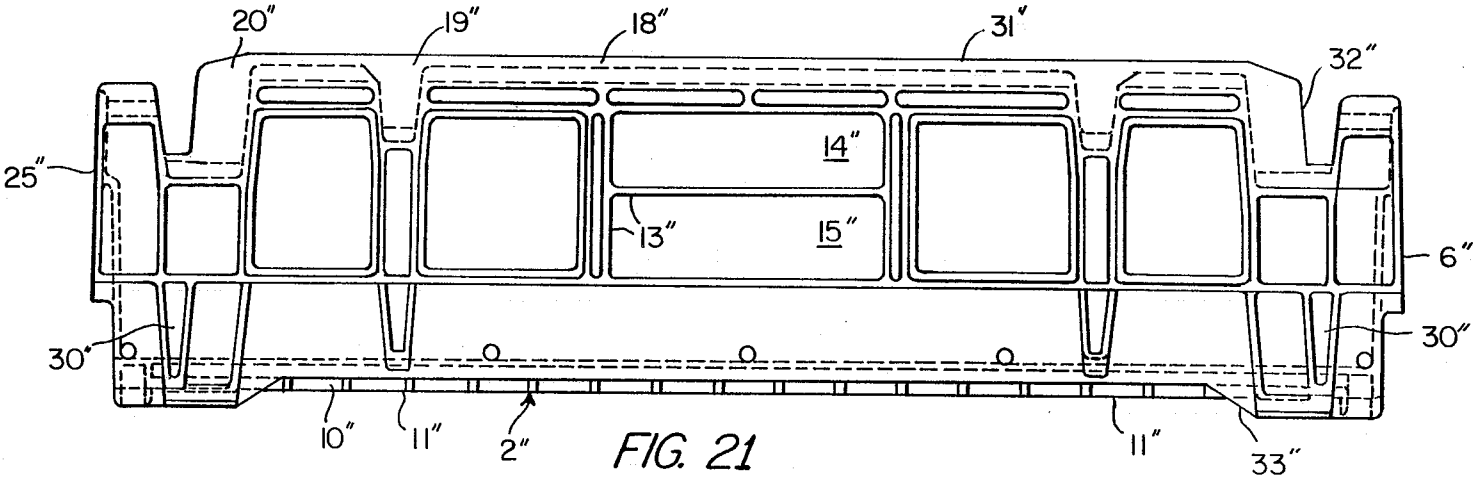
FIG. 21 is the opposite end elevational view of the tray according to FIG. 20.

The third embodiment of the tray of the invention is shown in FIGS. 20–24. Substantially the same interengaging structure and outboard blind stacking structure are provided as previously described, with it being noted that the guide feet 30″ and guide recesses 31″ extend downwardly to a greater extent than their counterparts of the first embodiment and correspondingly the large feet and large recesses extend downwardly to a greater extent than their counterparts of the first embodiment. This greater depth is correlated to the provision of greater depth corner structure with respect to the second embodiment at the bottom and lower height corner structure at the top. As shown in FIG. 21, the bottom surface 11″ terminates at a position spaced from each adjacent bottom corner, also evident from FIG. 22. This provides inwardly facing corner flanges 33 that are horizontally outward and vertically downwardly extending from the adjacent bottom surface 11″. The corner flanges are at the opposite terminal ends of each of the side walls 5‴, 6‴.

With the tray of FIGS. 20–24, the downwardly extending corner structure provides the flat bottom surface 11‴ sufficiently spaced above a support surface, such as a floor, so that a fork lift truck or the like may extend its forks easily beneath the tray without the provision of the chamfers 12 of the embodiment according to FIGS. 1,2 and 4. Additionally, the flat planar bottom surface 11″, particularly described with respect to the other embodiments provides, in FIGS. 20–24, the flat bottom surface that will, without interruption, engage a discontinuous support surface such as a roller conveyor to provide for full automation, with the depending corners being beyond the support of the narrower conveyor. Also, the flat bottom surface of the corner portions 34 will engage the upper edge 25″ of the buttresses, at the near side, during stacking in the cross-nested position to function as previously described with respect to the first embodiment. Further, the corner flanges 33 engage upper edges 25″ as the trailing edge of an upper tray slides across the lower tray at the completion of a blind stacking step. Accordingly, the trailing large feet and guide feet are correspondingly raised to clear the side wall allowing the large feet to engage within the channels along each end wall. In view of the similarity, as evidenced by like numerals, between the two embodiments, further description of the embodiment of FIGS. 20–24 is unnecessary.

Figure 26:
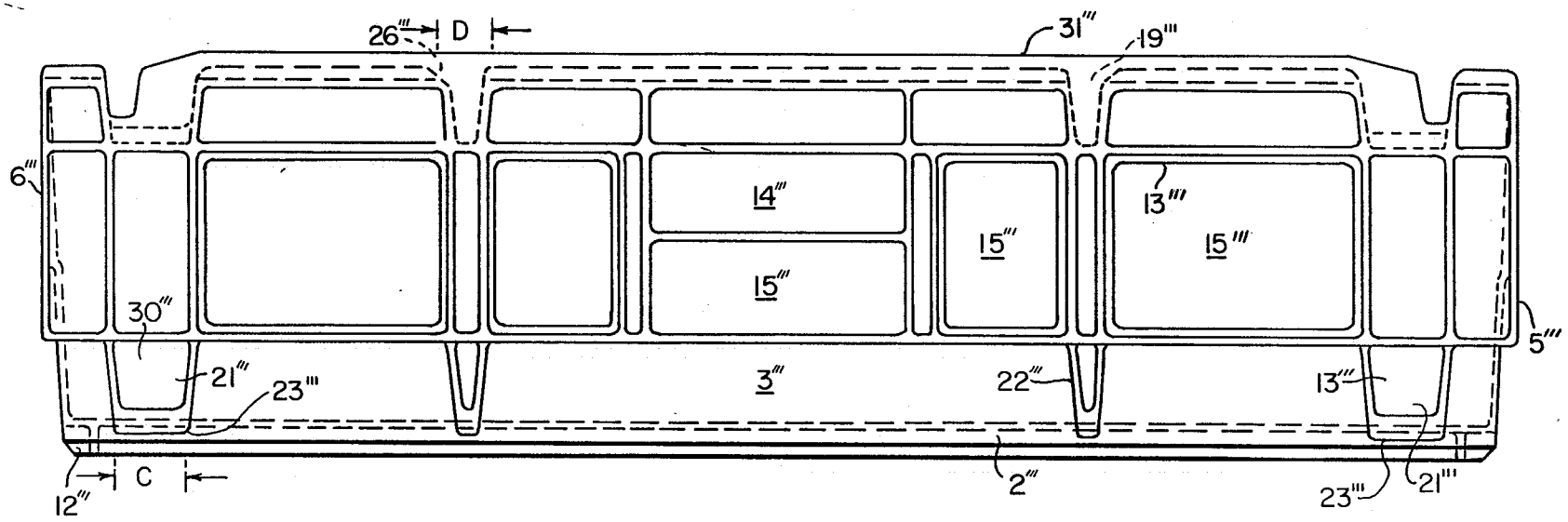
FIG. 26 is an elevational end wall view of a tray constructed according to a fourth embodiment of the present invention.
Figure 27:
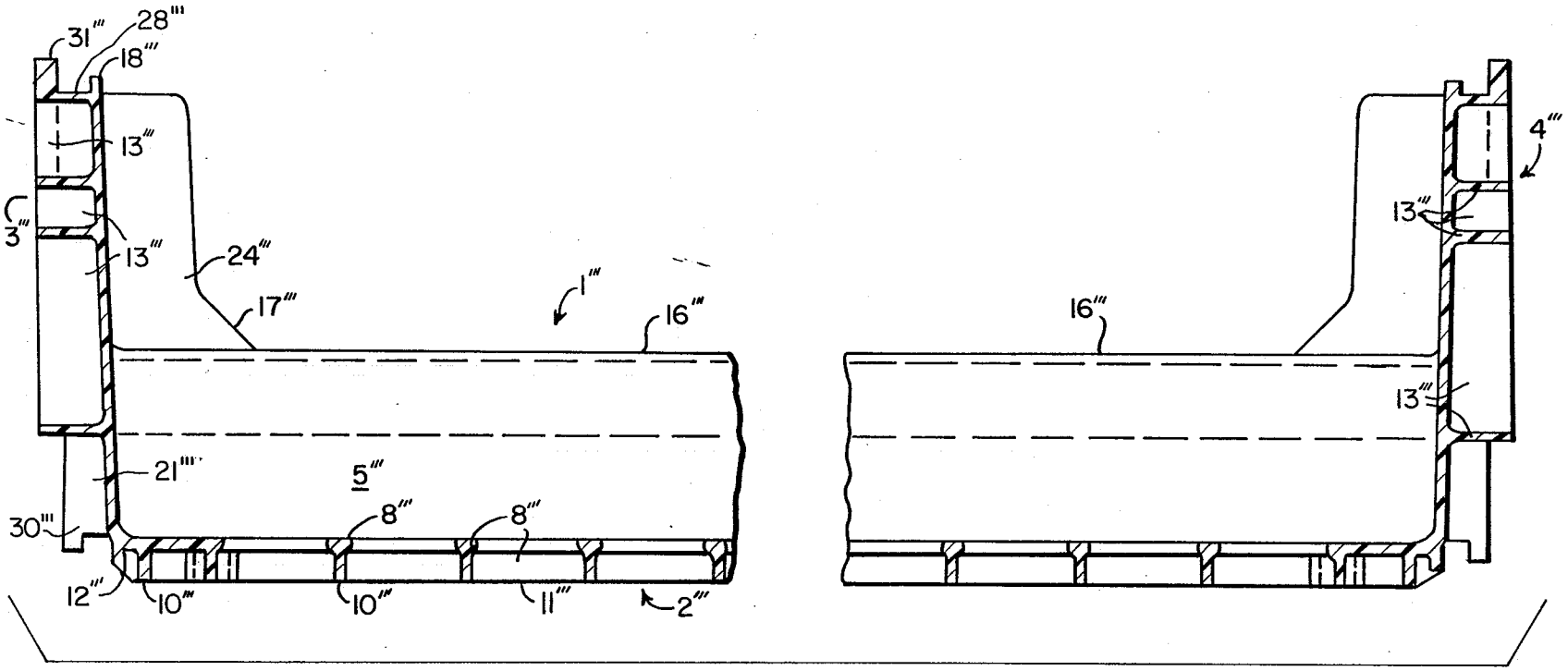
FIG. 27 is an elevational view, in cross-section, of one side of the tray according to the fourth embodiment, with the other side being identical.
Figure 28:
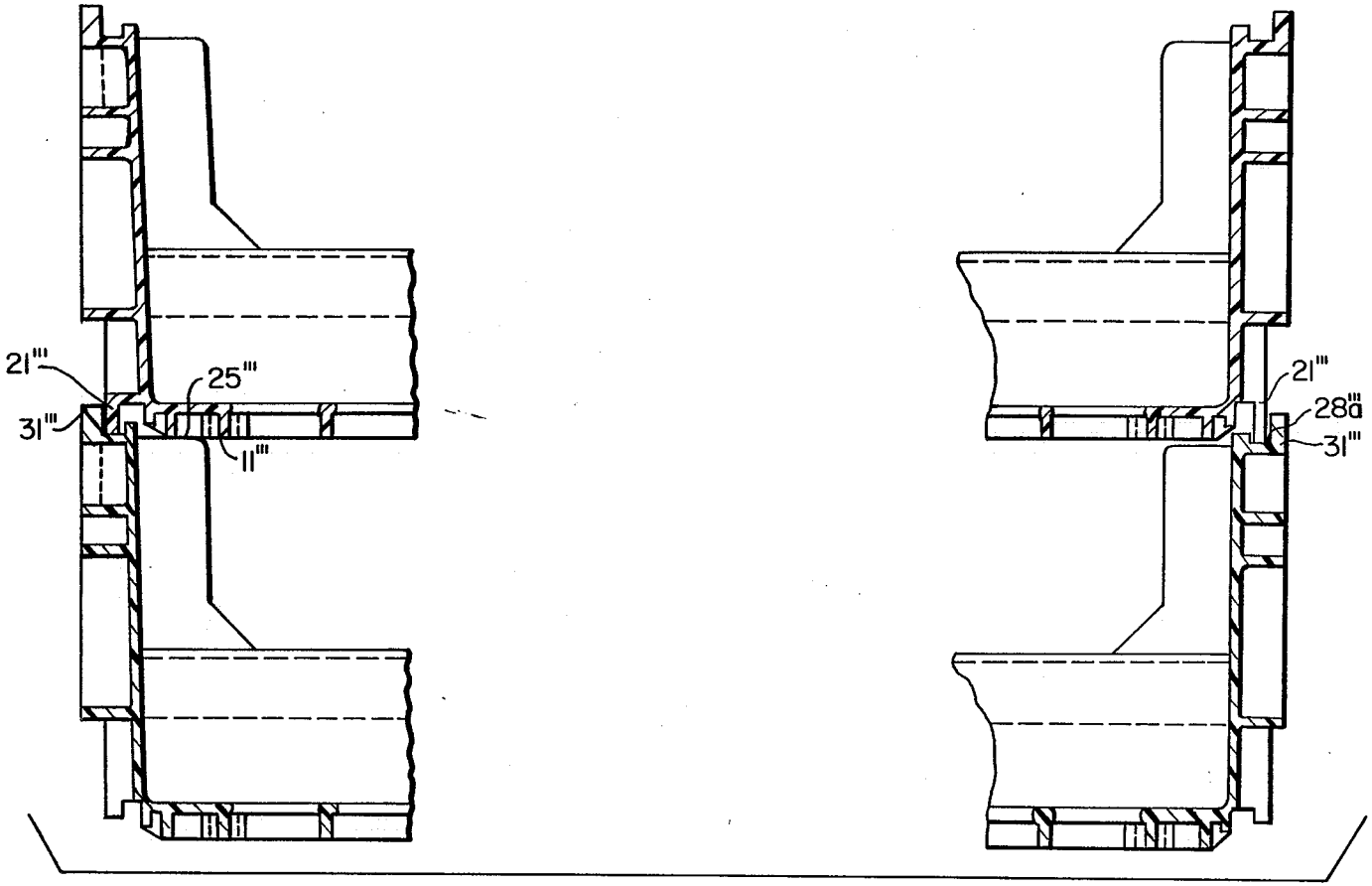
FIG. 28 is a cross-sectional view, with the center portion broken away, taken along line XXVIII—XXVIII in FIG. 29, blind stacking being shown.

In the fourth embodiment of the invention, shown in FIGS. 26–29, blind stacking is provided with continuous linear sliding engagement between upper and lower trays for both like orientation and 180 degree orientation in an alternative manner. The large feet 21‴ are coplanar with and outward, in the sliding direction parallel to the end walls 3‴, 4‴, of the small feet 22‴; and the large recesses 20‴ being coplanar with and outward, in the sliding direction parallel to the end walls of the small recesses 19‴. Further, rail 18‴ is linear and uninterrupted between the recesses. The large feet 21‴ have a bottom continuous linear sliding engagement surface 23‴, that extends downwardly into the channel formed between rails 18‴ and 31‴ to engage the bottom surface **28*a* of the channel 28‴. Similarly as shown in FIG. 26, feet 21‴ have a length in the sliding direction C, that is greater than the length D, in the sliding direction, of the distance between the continuous linear surfaces on opposite sides or across the small recess. This relationship of C greater than D provides for smooth sliding of the large feet 21‴ along the bottom surface of the channel formed between rails 18‴ and 31‴ even as the small recesses 19‴ are traversed by the large feet 21‴**

It is seen that if the feet 21‴, 22‴ and recesses 19‴, 20‴ were all the same size, which is not true in the present invention, then the foot 21‴ would tend to fall within the recess 19‴ and produce a discontinuity in the sliding motion during blind stacking, which could tend to knock over a stack of trays, produce annoyance with the operator and lost time, or prevent the use of automated equipment for blind stacking.

Figure 29:
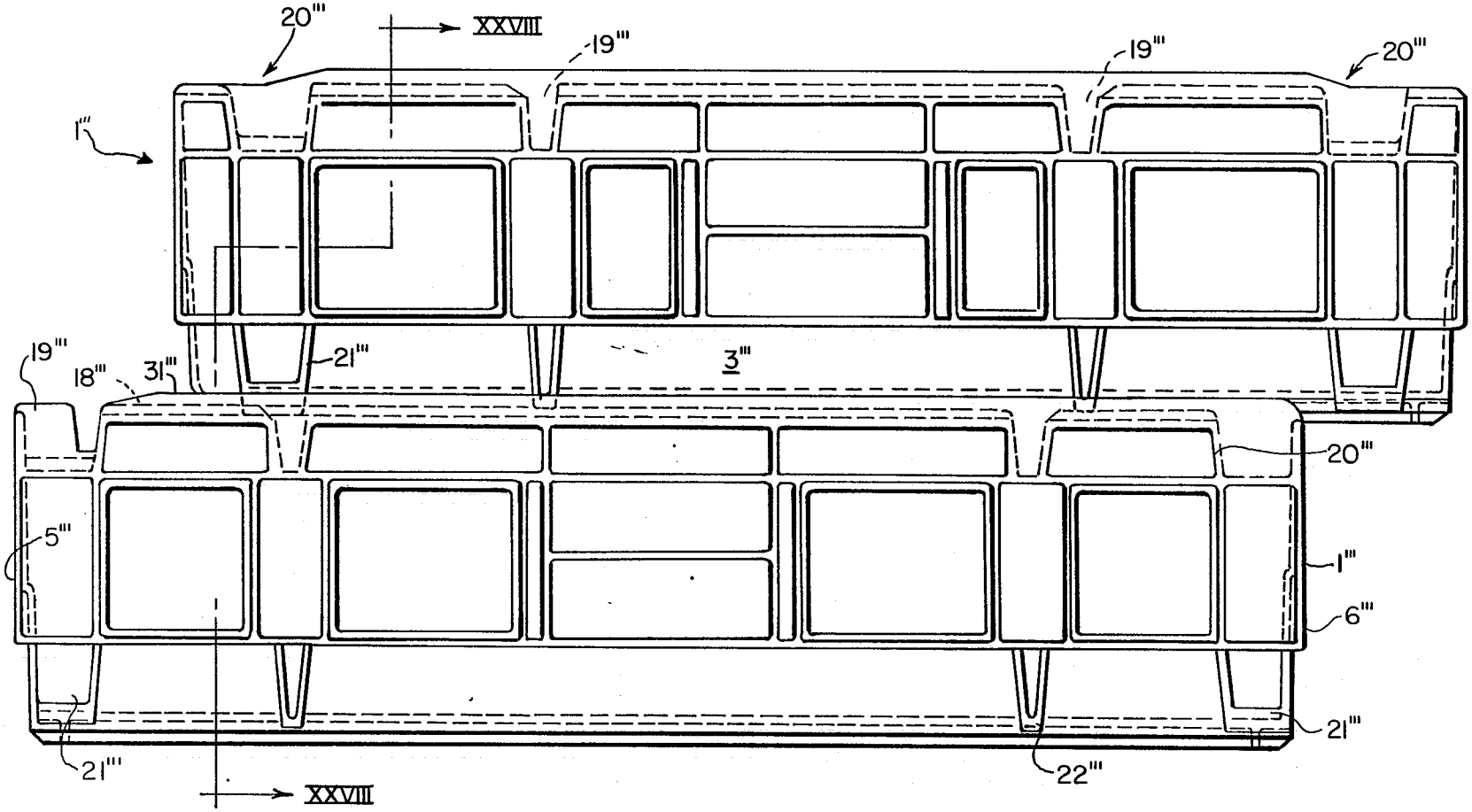
FIG. 29 is an elevational view of the end of two 180 degree oriented trays constructed according to the fourth embodiment of the invention sliding along each other during blind stacking.

As shown in FIG. 29, the pair of large feet 21‴ are closely adjacent the side walls 5‴ and 6‴ and the pair of larger recesses 20‴ are closely adjacent the side walls 5‴ and 6, so that the small feet 22‴ and small recesses 19‴ are effectively between the large feet 21‴ and large recesses 20‴, respectively. Thereby, the blind stacking provided by the fourth embodiment of the present invention provides continuous uninterrupted sliding engagement between the forwardmost large feet 21‴ shown in FIG. 29 of the upper tray as they slide over the small recesses 19‴.

In addition to or in place of the far side, with respect to the operator during blind stacking, blind stacking features described above, the following outboard blind stacking features may be provided. As noted above, the interengaging structure providing high and intermediate level stacking is preferably all coplanar and in addition provides blind stacking functions at the far portion. The outboard blind stacking structure is spaced outwardly of the plane for the interengaging structure, for each of the end walls; the structure could be modified by placing the outboard structure inboard in an equivalent manner.

In each of the embodiments of the trays constructed according to the present invention, the interengaging structure permits stacking of trays of one embodiment with another embodiment to attain the high and low stacked positions, except in the case of the trays constructed according to FIGS. 3, 5, 6 and 25 wherein only one height of stacking is attainable. Further, blind stacking is permissible between trays of each of the embodiments, but it is preferred that the outboard blind stacking structure be included to provide restraint against lateral shifting during blind stacking of trays.

Figure 3:
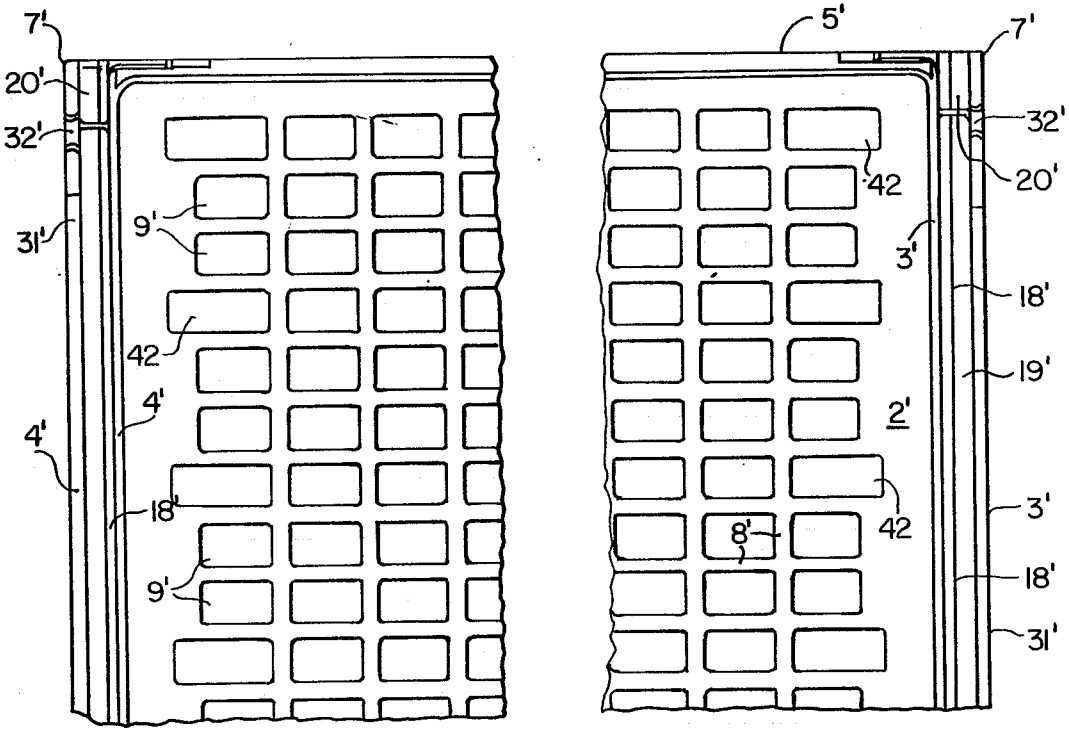
FIG. 3 is a partial top view, the center portion having been removed to avoid duplication, of the bottom one-half of a tray constructed according to a second embodiment of the invention, with the other one-half of the tray being a mirror image.
Figure 22:
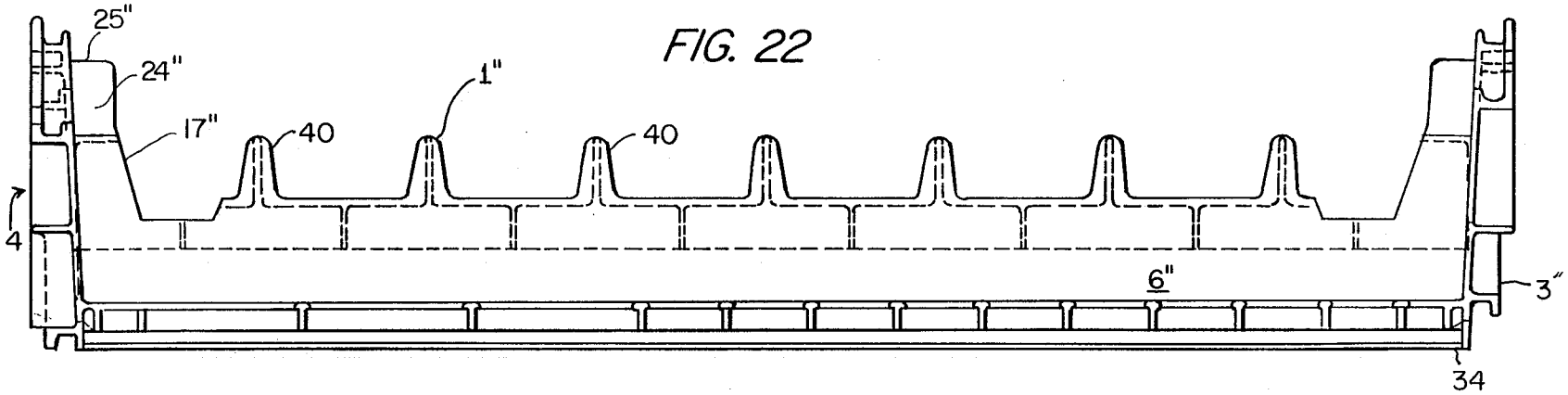
FIG. 22 is a side elevational view, taken in cross section along line XXII—XXII of FIG. 23, of the tray according to FIG. 20, with the cross-sectional view along the same cross-section line taken in the opposite direction being a mirror image.
Figure 23:
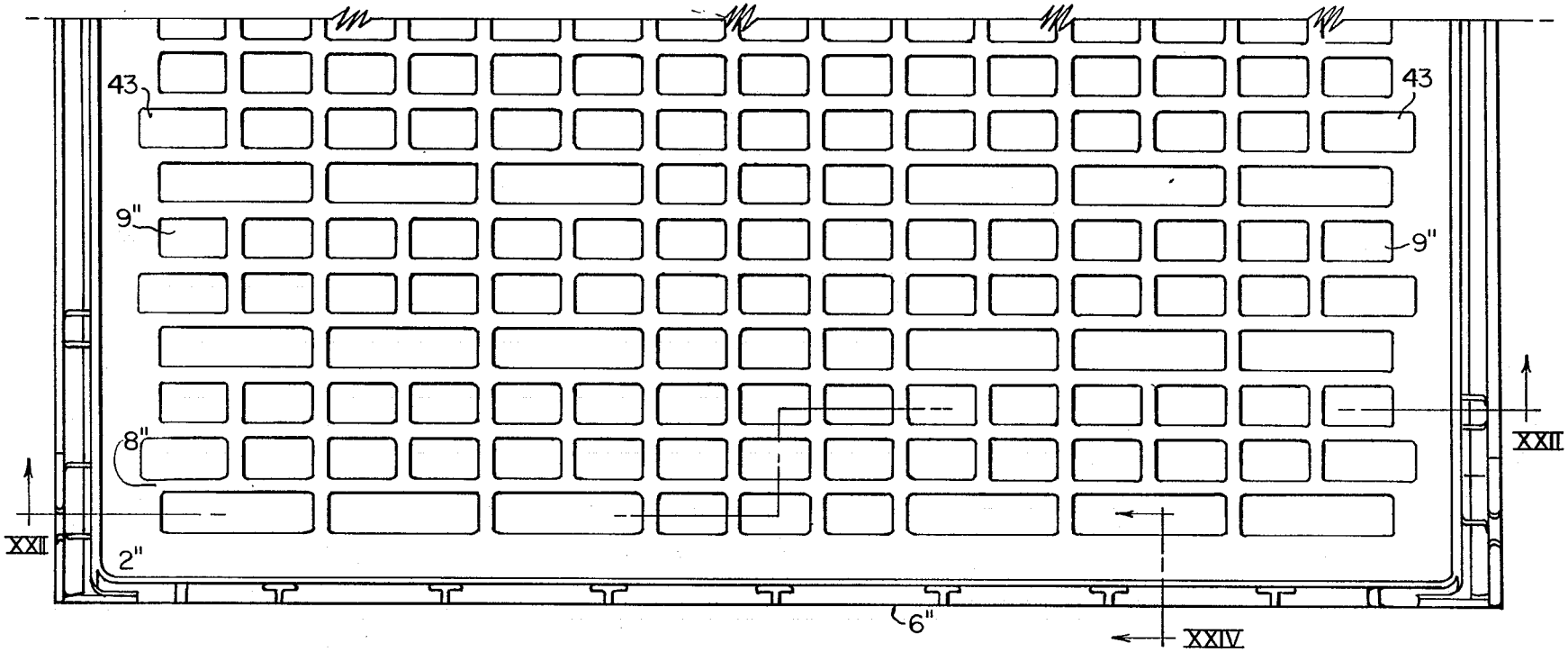
FIG. 23 is a top plan view, of one-half of the tray as shown in FIG. 20, with the other half being a mirror image.
Figure 24:
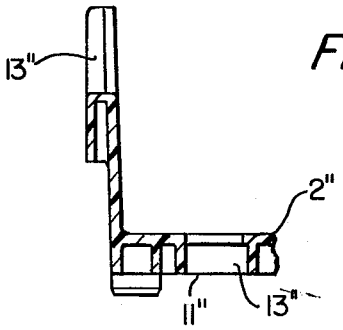
FIG. 24 is a partial cross-sectional view taken along line XXIV—XXIV in FIG. 23.

As mentioned, in cross-nesting the adjacent trays are 90 degree oriented. The trays of the first and fourth embodiments have a top edge along the side wall that is smooth or continuous and uninterrupted. However, according to another feature of the invention, the side walls of the trays constructed according to the second and fourth embodiments, as shown in FIGS. 22 and 25 respectively, have product retention fingers 40 and 41 respectively along each side wall. Thus, when the trays are cross-nested the product retention fingers penetrate the through passages in the bottom of the trays. FIGS. 3 and 23 show top views of the bottoms of the trays of the second and third embodiments respectively. The trays of the second embodiment are constructed with reduced size end and side walls than the trays of the third embodiment. Accordingly, it is preferred that in the use of a system of trays constructed according to the present invention, a first series of trays, for example constructed according to the second embodiment of the invention, would not be cross-nestable with a second series of trays, for example constructed according to the third embodiment of the present invention. Accordingly, the product retention fingers 40 of the first series and 41 of the second series have a different pattern or spacing relative to one another and between the side walls of the respective trays. Corresponding to this pattern is formed a matching pattern of elongated slots 42 and 43 as shown in FIGS. 3 and 23.

When the trays within the first series are cross-nested with one another, the product retention fingers 41 penetrate the pattern of elongated slots 42 to allow the upper cross-nested tray to rest flat along the bottom tray, or with the bottom surfaces of the upper and lower trays substantially parallel. The same is true, of course, for the trays of the second series in that the product retention fingers 41 are patterned to project through the pattern of elongated slots 43 thus allowing cross-nested trays within the second series to form a cross-nested stack with the bottoms of adjacent trays being supported in substantially parallel relationship with one another.

In order to prevent cross-nesting between trays of a first series and trays of a second series, the pattern of product retention fingers along the side walls of a first series of trays and corresponding elongated slots in the grid structure of the bottom of the first series of trays is different from that of the second series of trays. Accordingly, when a tray of a first series, for example a tray constructed according to the second embodiment, is attempted to be cross-nested onto a tray constructed according to the third embodiment, the product retention fingers along the side wall of the lower tray will penetrate certain ones of the through passages 9' in the bottom of the upper tray, but will not penetrate the elongated slots of the upper tray. As a result of the through passages being provided to extend outwardly only to a dimension that is less than the length between opposing ones of the product retention fingers, one row (side) of product retention fingers will penetrate corresponding ones of the through passages, but the other row (side) of product retention fingers will abut the bottom surface of the upper tray between where the through passages terminate and the end wall begins. Accordingly, cross-nesting of trays of one series with another series will result in the upper tray remaining in a canted position wherein the bottoms of the upper and lower trays are not parallel to one another. As a result, the mixing of one series of trays with another during cross-nesting will be readily apparent and the further cross-nesting of trays onto the canted stack of trays of different series will be prevented.

The blind stacking feature of the trays constructed according to the present invention is accompanied by a blind unstacking feature. When many trays are stacked in a vertical stack that reaches a height exceeding that of the operator forming the stack, the blind stacking feature enables additional trays to be added to the stack so long as a front portion of a tray to be added to the stack can engage the top most tray of the stack to push the tray being added up over the top stacked tray and onto the stack. In the trays constructed according to the fifth embodiment of the present invention, features are included that allow for the blind unstacking of the trays. Thus, as with blind stacking, the trays constructed according to the fifth embodiment can be blind unstacked, or removed from a stack by grabbing only one side of the tray that faces the operator and manipulating the side that is grasped to disengage the stacking structures and slide the tray off the top of the stack, even when the stack has reached a height that is greater than the height of the operator handling the trays.

Figure 33:
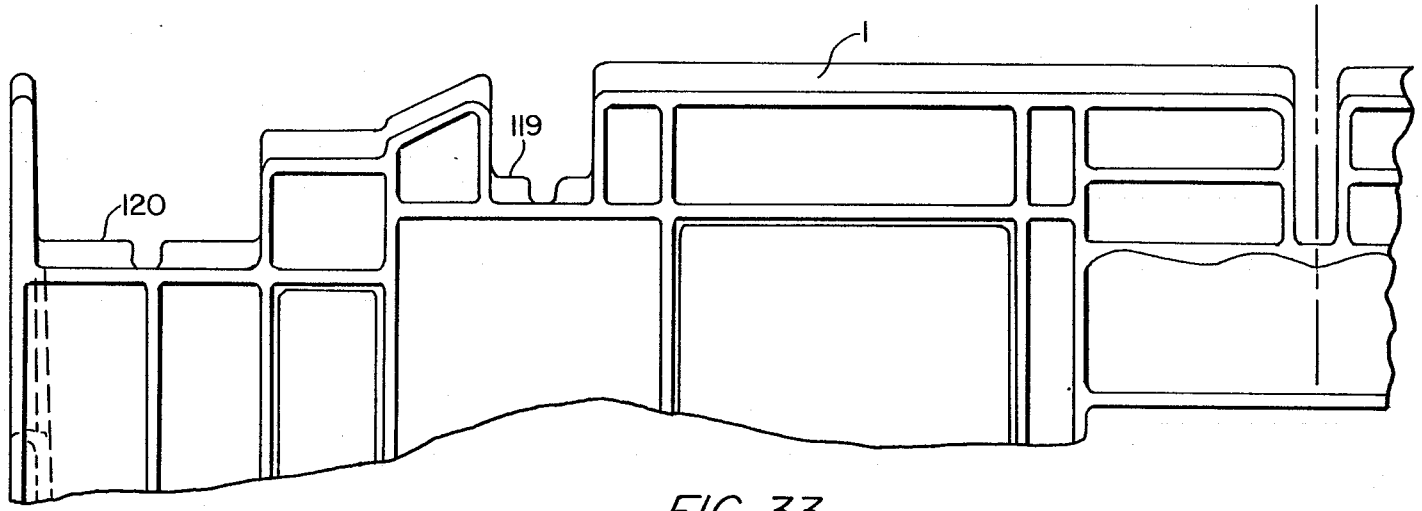
FIG. 33. is a partial elevational view similar to the view shown in FIG. 31, but of the reverse side of the end wall shown in FIG. 32.
Figure 34:
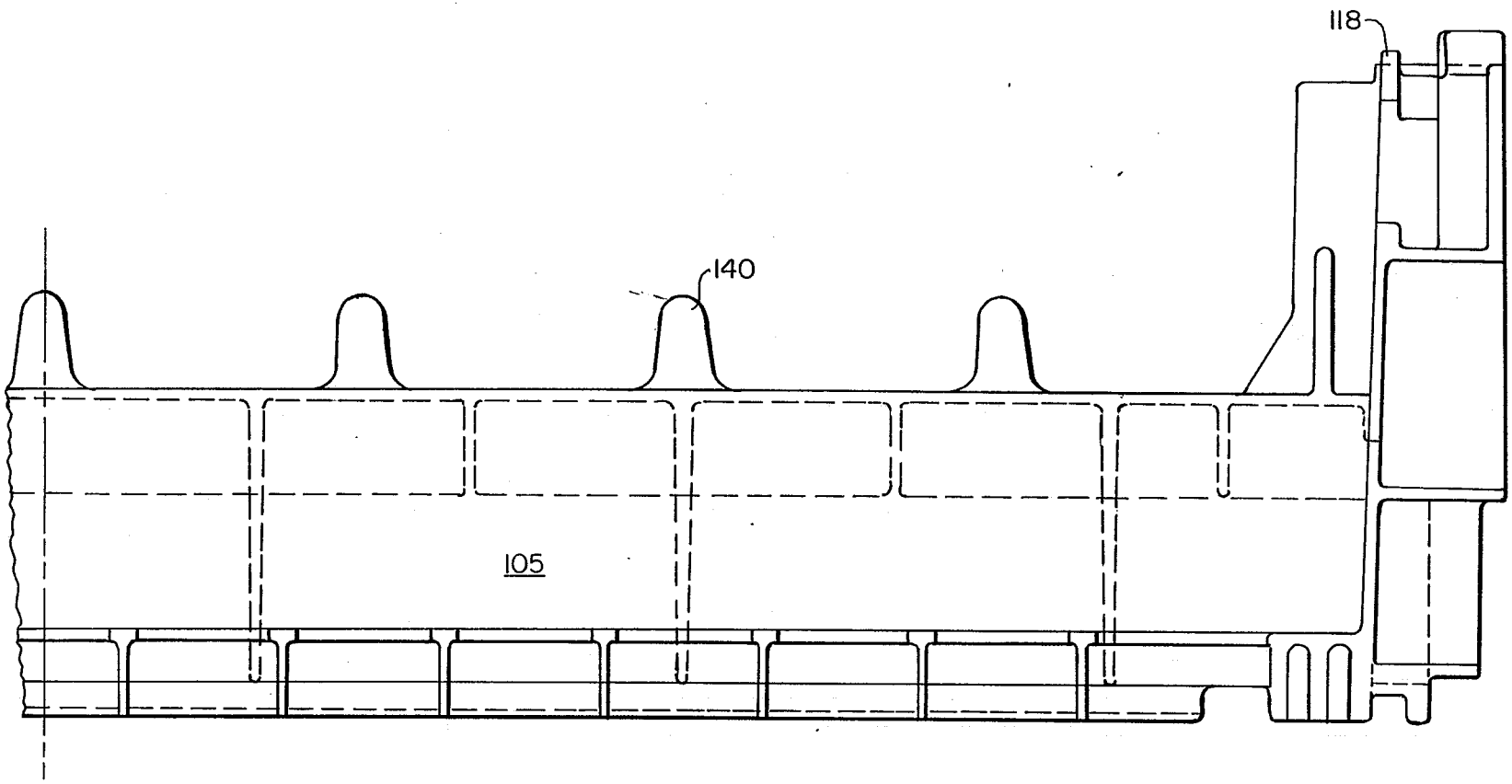
FIG. 34 is an elevational view of one half of one side of the tray according to the fifth embodiment, with the other half being a mirror image thereof and the other side being identical.
Figure 35:
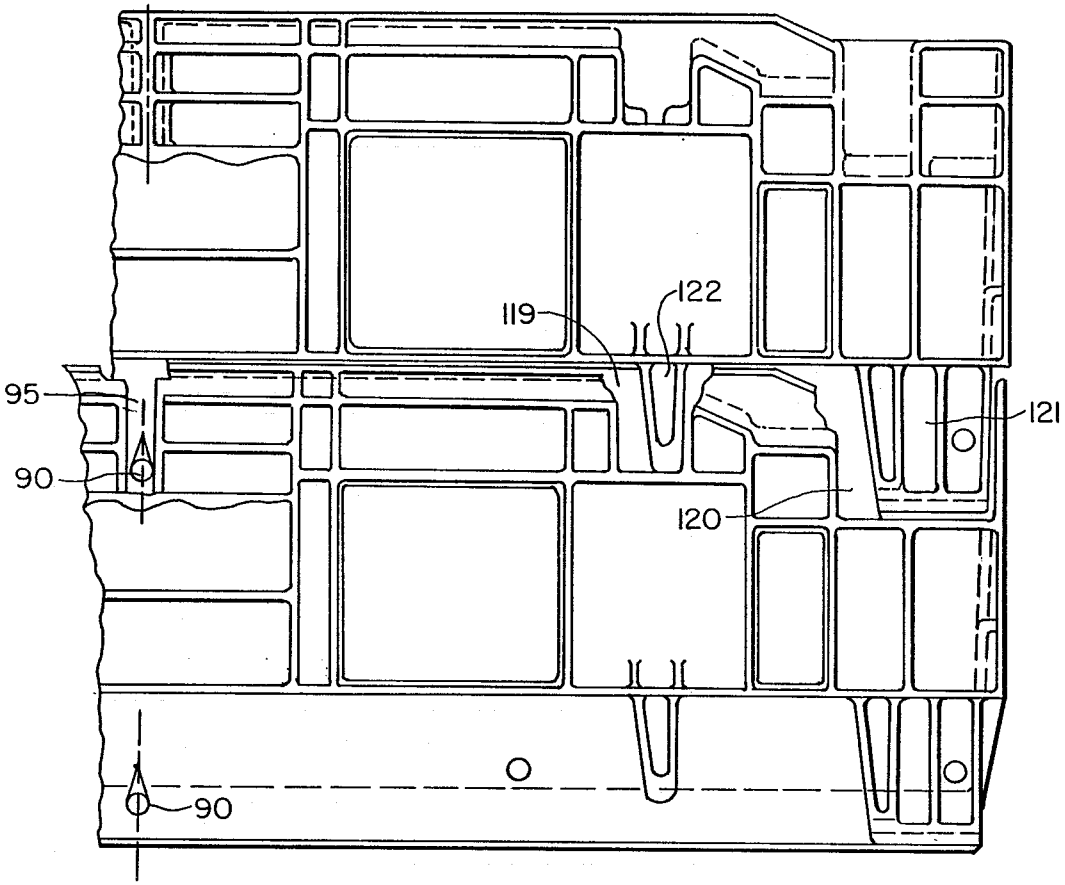
FIG. 35 is an elevational view of the ends of two like trays constructed according to the fifth embodiment in a stacked position.

FIGS. 30–34 show the details of the trays constructed according to the fifth embodiment of the present invention, and FIG. 35 shows two such trays stacked on top of one another in a low stacked position. The trays are constructed with features similar to those of the trays of the other embodiments. The trays have a bottom wall 102, and opposed end walls 103 and 104 shown in FIGS. 30 and 32 respectively. A side wall 105 of the trays is shown in FIG. 34 with the opposite side wall not shown, but being identical to side wall 105. The end and side walls are joined to the bottom wall of the container or tray to form an upwardly opening rectangular tray that is generally similar to the trays of the first four embodiments of the present invention. The trays shown in FIGS. 30–40 are of the same size as the trays of FIGS. 1, 2, 4 and 7–15 constructed according to the first embodiment of the invention, but the features directed to the blind unstacking capability of these trays can be included with the smaller size trays of the second embodiment shown in FIGS. 3, 5, 6 and 25 as well as with the trays of the other embodiments.

Figure 30:
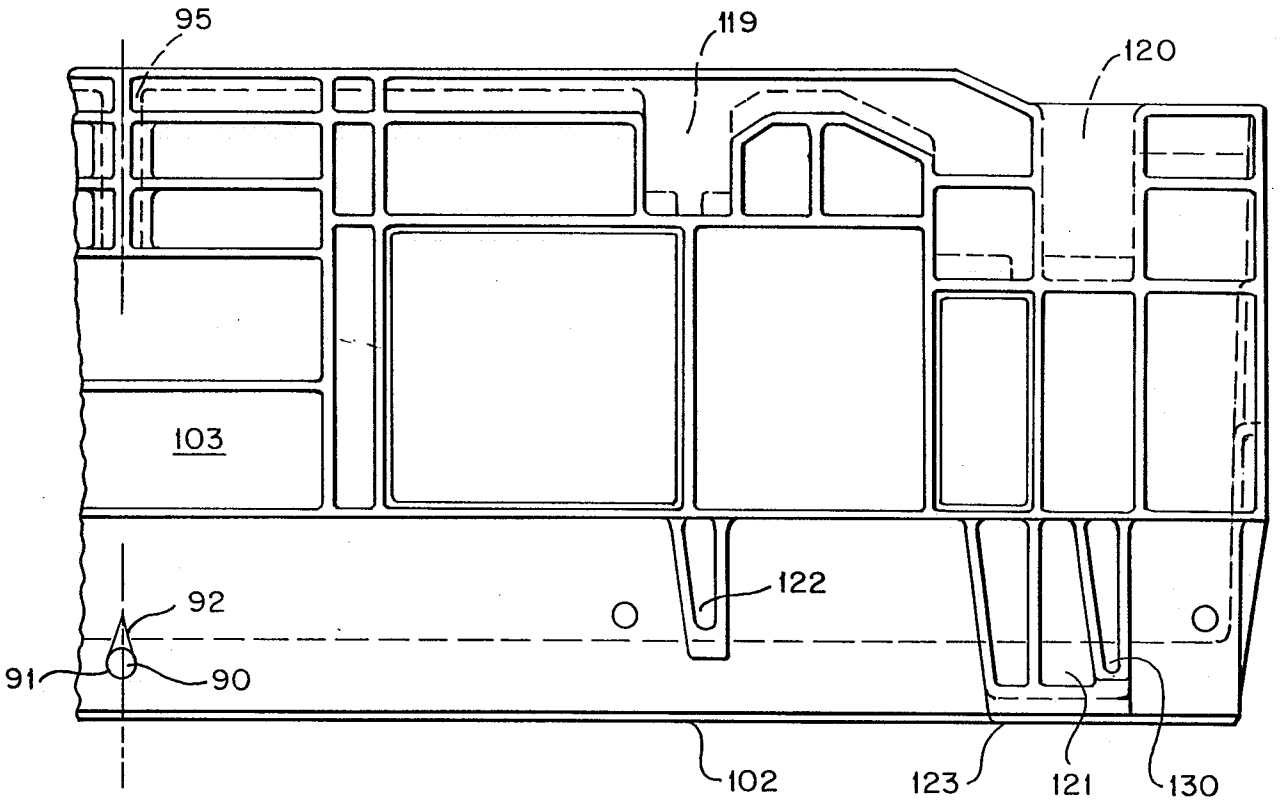
FIG. 30 is an elevational end wall view of half of a tray constructed according to a fifth embodiment of the present invention, the other half end wall being a mirror image.

As shown in FIG. 30, the tray has large feet 121 with adjacent guide feet 130 and small feet 122. Large recesses 120 and small recesses 119 are provided to receive the large and small feet respectively. The feet 121 have bottom portions 123 that rest on the bottom of the large recesses when the trays are stacked as shown in FIG. 35.

Figure 31:
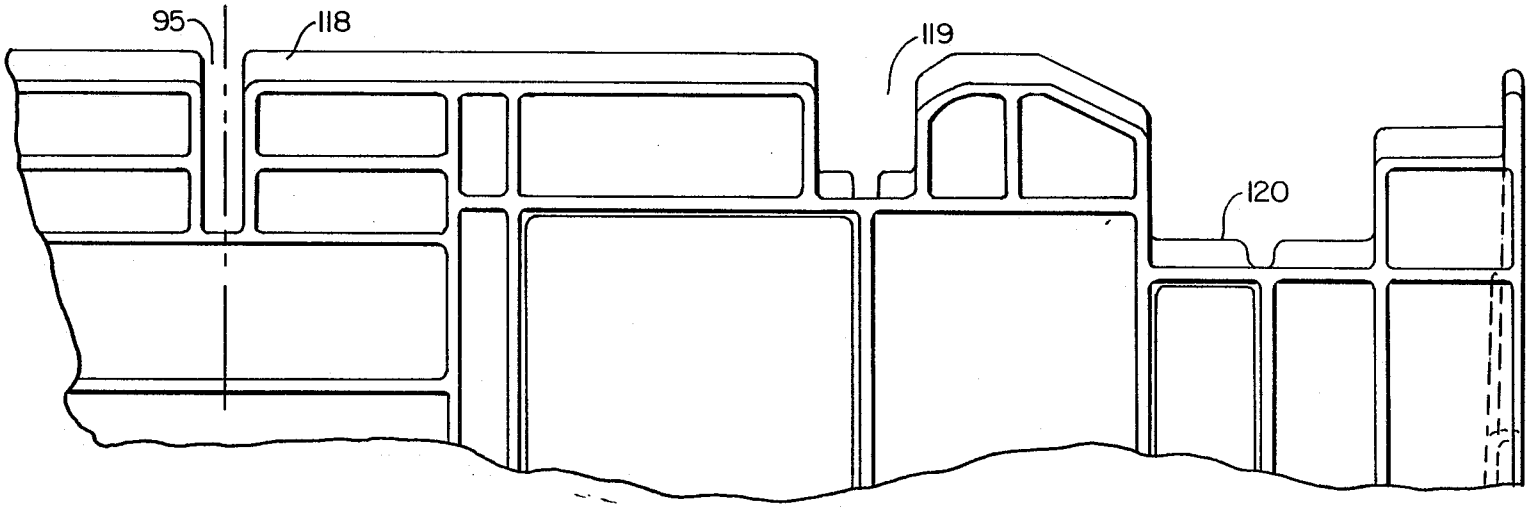
FIG. 31 is a partial elevational view of the reverse side of the end wall shown in FIG. 30.
Figure 32:
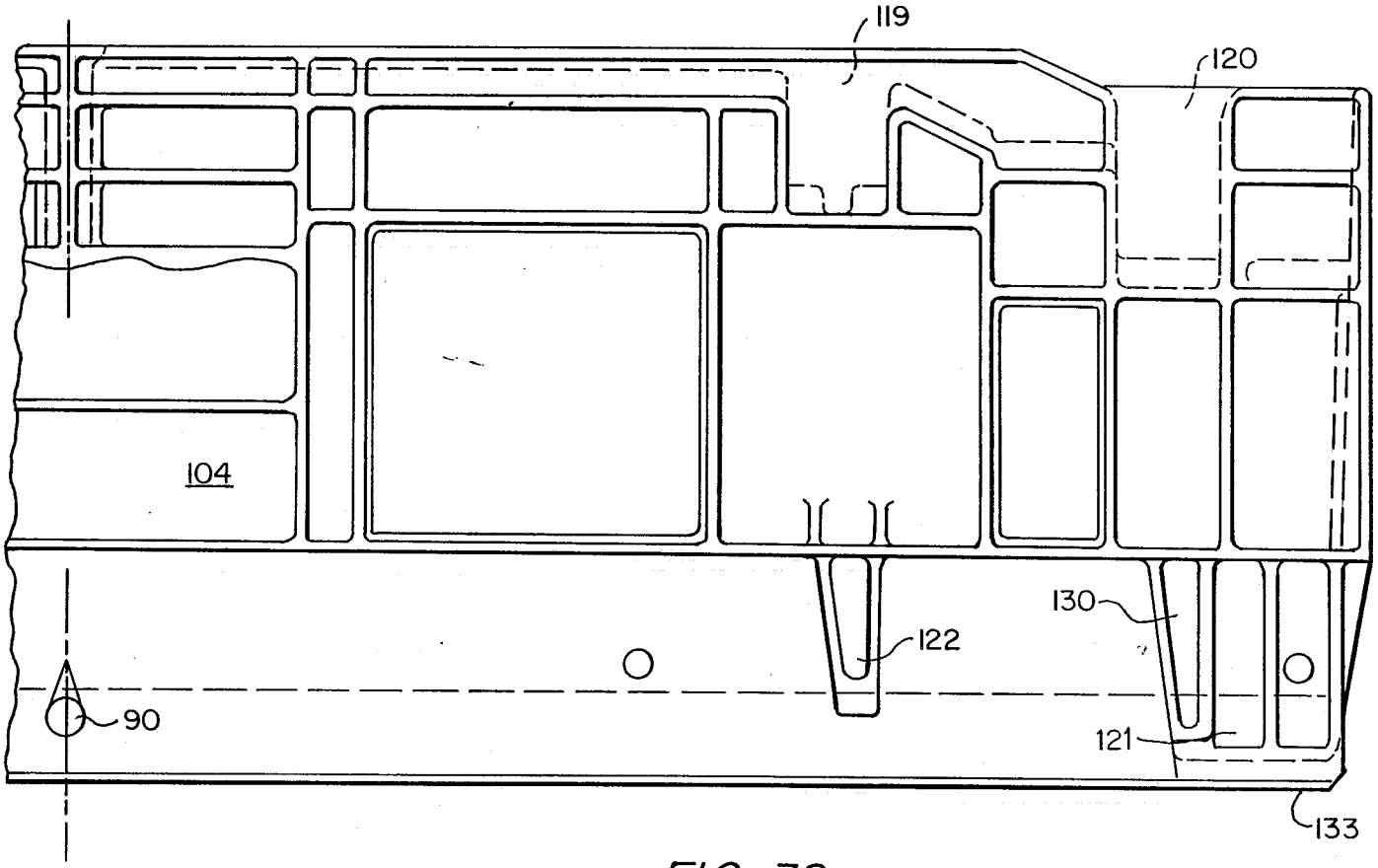
FIG. 32 is an elevational view of the opposite end wall of the tray according to FIG. 30.

As shown in FIGS. 30 and 32, a projection or lug 90 is shown that extends outwardly from each end wall along a bottom portion of the end wall. The projection 90 has a rounded bottom contour 91 that is preferably semicircular. The projections 90 are aligned along a center line of the tray midway between the side walls of the tray. Formed in the guide rail 138 along the top portion of each end wall is a slot 95 for receiving the projections when the trays are in either of the high or low stacked positions. The slot 95 and recesses 119, 120 are best shown in FIGS. 31 and 33.

FIG. 34 shows a side view of one half of the trays constructed according to the fifth embodiment of the present invention with the other half of the tray being a mirror image of the half shown and the other side of the tray being identical to the side shown in FIG. 34. Product retention fingers 140 are shown, which serve a similar purpose and function as the product retention fingers 40 shown in FIG. 22 of the third embodiment of the present invention.

FIGS. 35–40 show the blind unstacking structure of the trays according to the fifth embodiment as they are used in unstacking an upper tray from a lower tray of like construction. As shown in FIG. 35, the large feet 121 at one side of the upper tray are supported within the large recesses 120 of a lower tray when the two trays are in the stacked position as shown. Also, the small feet 122 are supported in the small recesses 119 in the stacked position shown. In comparison to the close fit between the large and small feet and their respective recesses for the trays constructed according to the first four embodiments of the present invention, the large and small recesses 120 and 119 of the trays constructed according to the fifth embodiment of the invention are wider than the width of the foot by an offset distance as shown in FIG. 35. As a result of the projections 90 being received within the slots 95, however, lateral or side to side shifting of an upper tray with respect to a lower tray is prevented.

Figure 36:
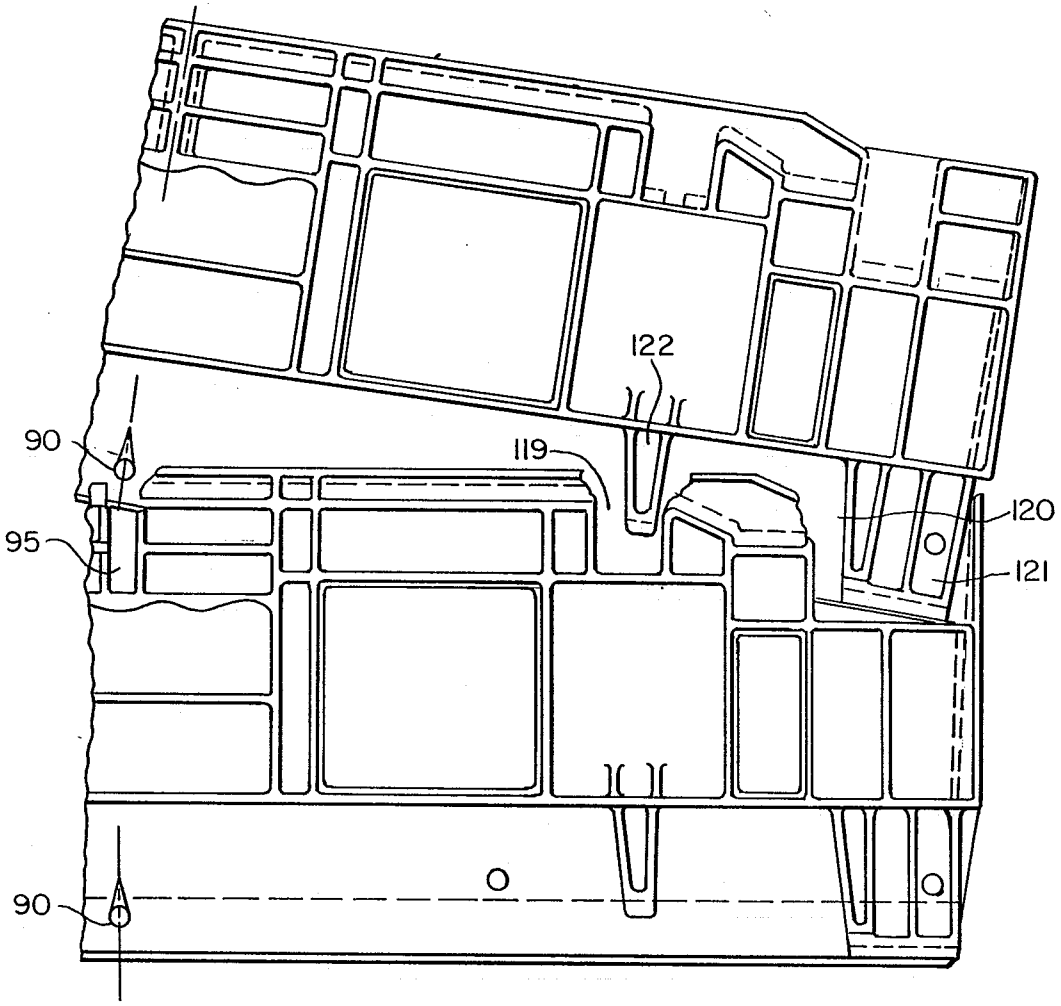
FIG. 36 is an end elevational view of the trays shown in FIG. 35 with the upper trays shown raised at one end.

As shown in FIG. 36, one method of blind unstacking the trays constructed according to the fifth embodiment involves grasping one side of an uppermost tray on a stack of trays and rotating or pivoting the upper tray relative to the lower tray about the large feet at the opposite side of the tray from where it is grasped. The bottoms 123 of the large feet rest in the bottom of the large recesses of a lower tray to enable the trays to be rocked or raised upwardly by the operator at the opposite side, which is ordinarily the only side accessible to the operator handling the uppermost tray in a tall stack of trays.

Figure 37:
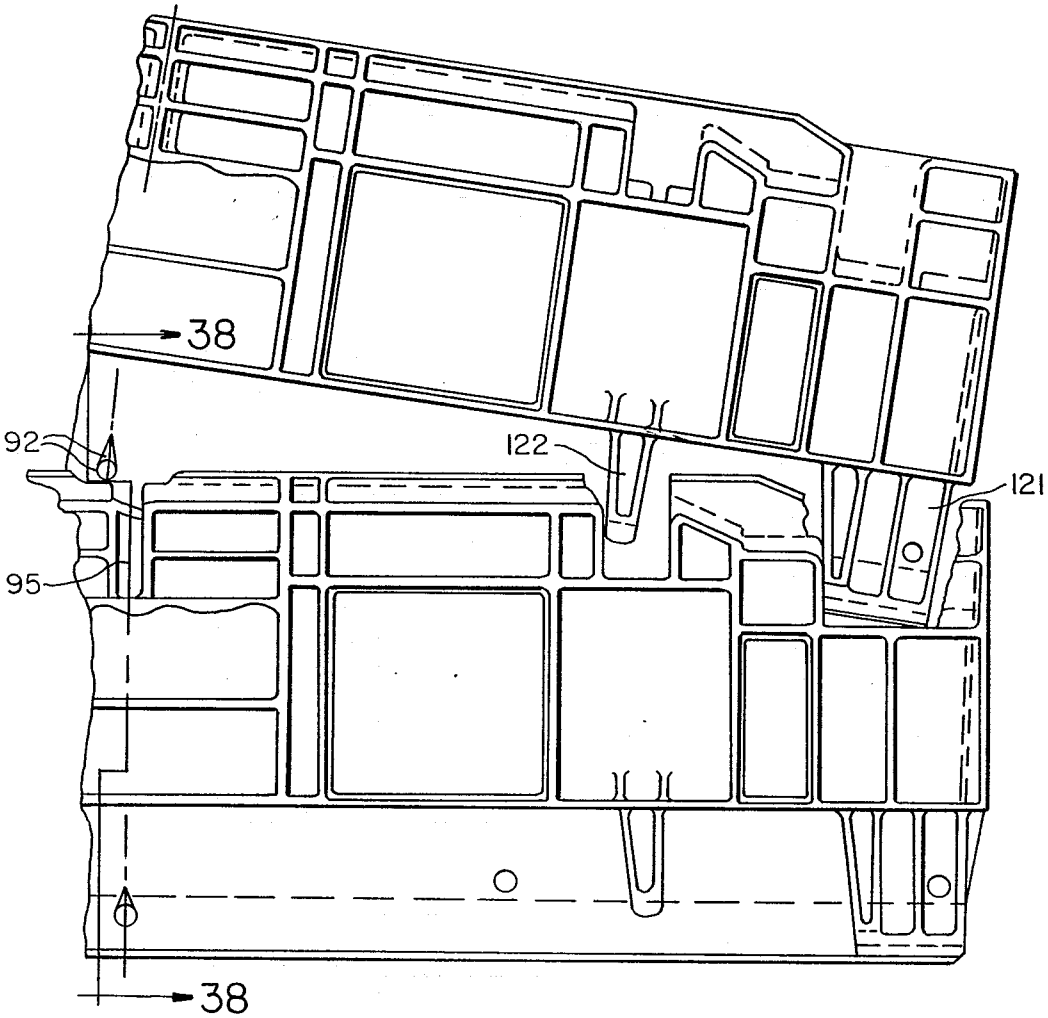
FIG. 37 is an end elevational view of the two trays of FIG. 36 showing the upper tray raised up at one end and shifted toward the raised end with respect to the lower tray.

As shown in FIG. 37, the wider dimension of the large and small recesses allows the uppermost tray to be pulled toward the side that is raised, as shown in FIG. 36. In this way after the projections 90 are disengaged from the slots 95 the upper tray is translated, or laterally shifted in the sliding direction even though the large feet 121 remain engaged in and supported within the large recesses 120.

Figure 38:
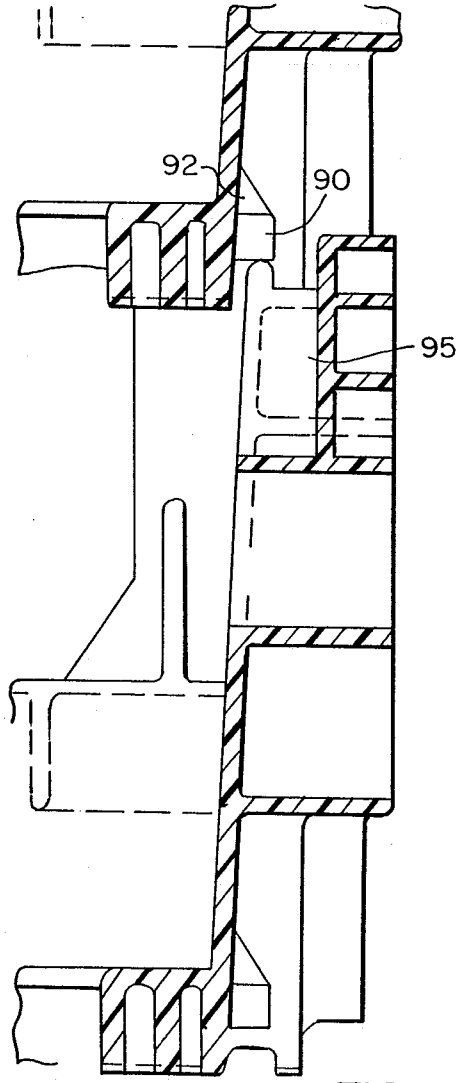
FIG. 38 is a partial section view taken along line 38—38 of FIG. 37.

By raising one side of the upper tray as shown in FIG. 36, the projections of the upper tray are lifted upwardly out of the slots 95. The angle at which an upper tray must be rotated about the large feet in the first pivoting step in unstacking an upper tray is determined by the position along the end wall of the projections 90. The projections are clear of the slots when an upper tray has been pivoted about the large feet on the large recesses of an adjacent lower tray at a fixed threshold angle, as shown in FIG. 36. At this point, the small feet are still engaged within the small recesses 119. By pulling the upper tray toward the raised side, the small and large feet are shifted within their respective recesses as a result of the large and small recesses having a greater dimension than the width of the feet. Thus, projections 90 become vertically misaligned with slots 95 such that the projections are in position to engage the inner stacking rail 118, as shown in FIGS. 37 and 38. The extent of vertical misalignment between the projections 90 and slots 95 need only be three-sixteenths to five-sixteenths of an inch, and the offset dimension between the width of the large and small recesses and the width of the large and small feet need only be three-eighths to one-half of an inch.

Figure 39:
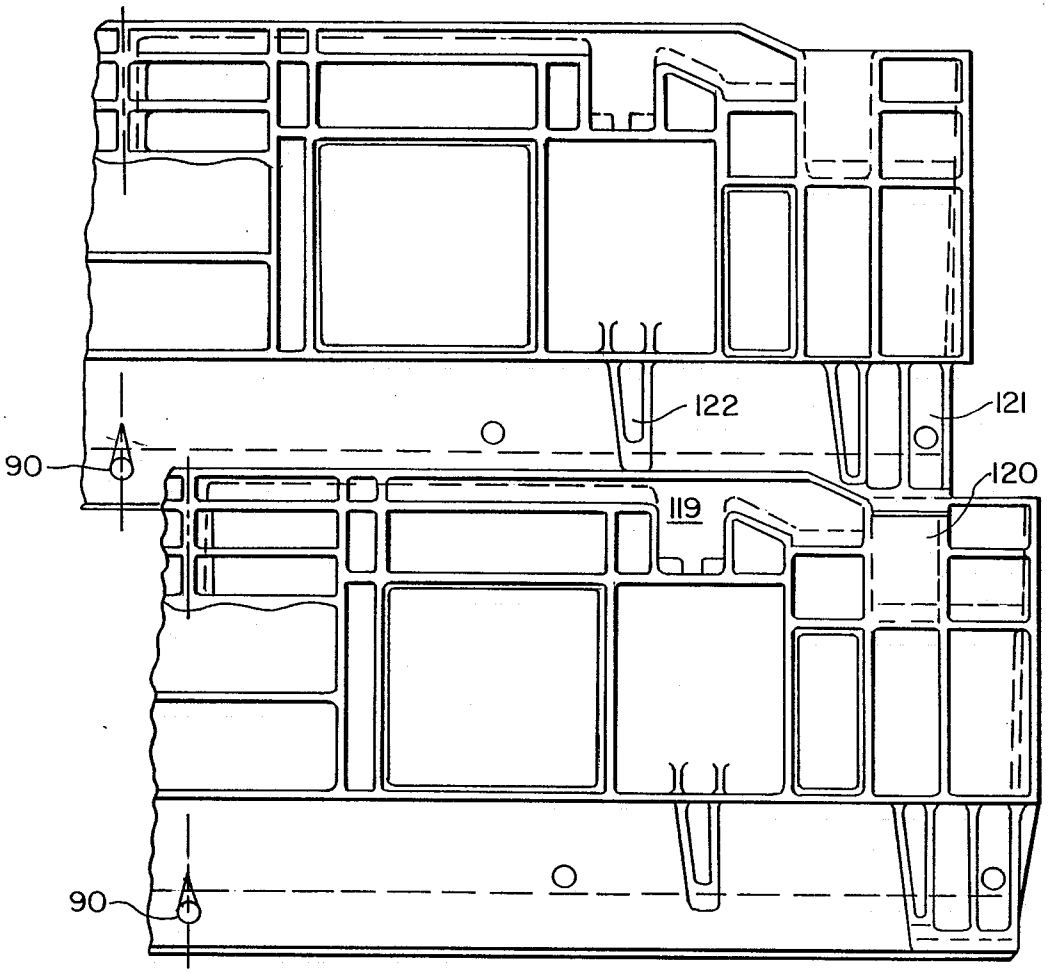
FIG. 39 is an elevational view of the trays of FIG. 37 showing the upper tray in an unstacked position with respect to the lower tray.

Once the upper tray is rocked into the position shown in FIGS. 37 and 38, the projections 90 engage the inner stacking rail 118 to enable the upper tray to be pivoted about a pivot axis extending between the projections to vertically disengage the large and small feet from their respective recesses as shown in FIG. 39. The projections 90 are buttressed or supported by flanges 92 so that the projections can support the weight of the tray during the pivoting. As shown in FIG. 38, the projections 90 extend outwardly a distance sufficient to engage the stacking rail 118, but not so far as to interfere with the sliding engagement between the upper and lower trays during the remainder of the blind unstacking procedure.

Figure 40:
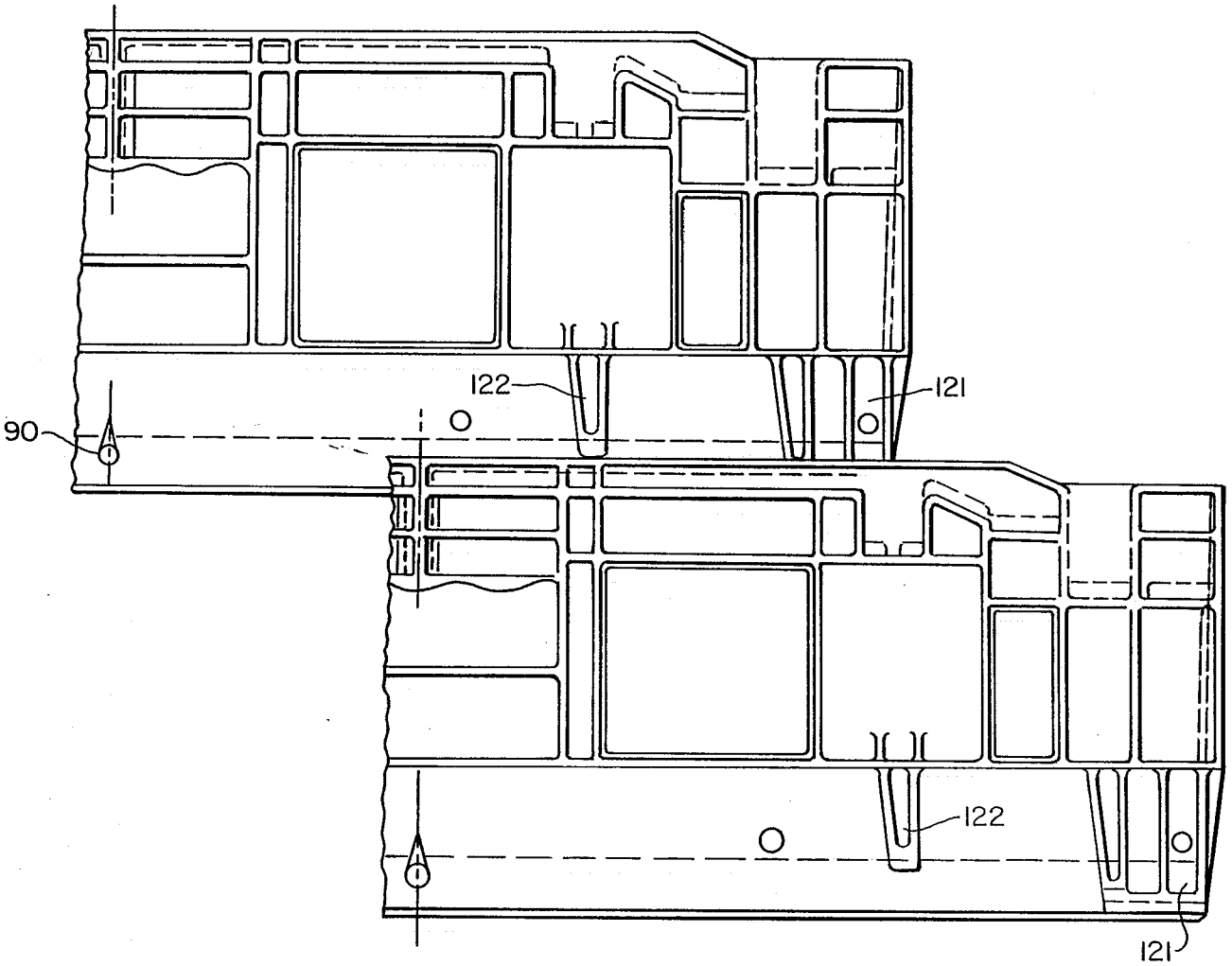
FIG. 40 shows the trays shown in FIG. 38 wherein the upper tray is in a further unstacked position with respect to the lower tray.

FIGS. 39 and 40 show the upper tray in positions of unstacking the upper tray from the lower one. In FIG. 39, the upper tray is shifted or moved to the left with respect to the lower tray a distance sufficient to engage the stacking structures of the upper and lower trays so that the orientation between the upper and lower trays is parallel. At this point, the large feet and small feet are vertically disengaged from the respective recesses and the side of the upper tray initially raised is shifted off of the vertical stack of trays a distance sufficient to enable an operator to thereafter pull the tray down off the top of the stack. Alternatively, the operator can continue the unstacking procedure by sliding the upper tray relative to the stack to the position shown in FIG. 40 in order to expose a greater portion of the upper tray for pulling it downwardly off of a tall stack of trays.

Figure 41:
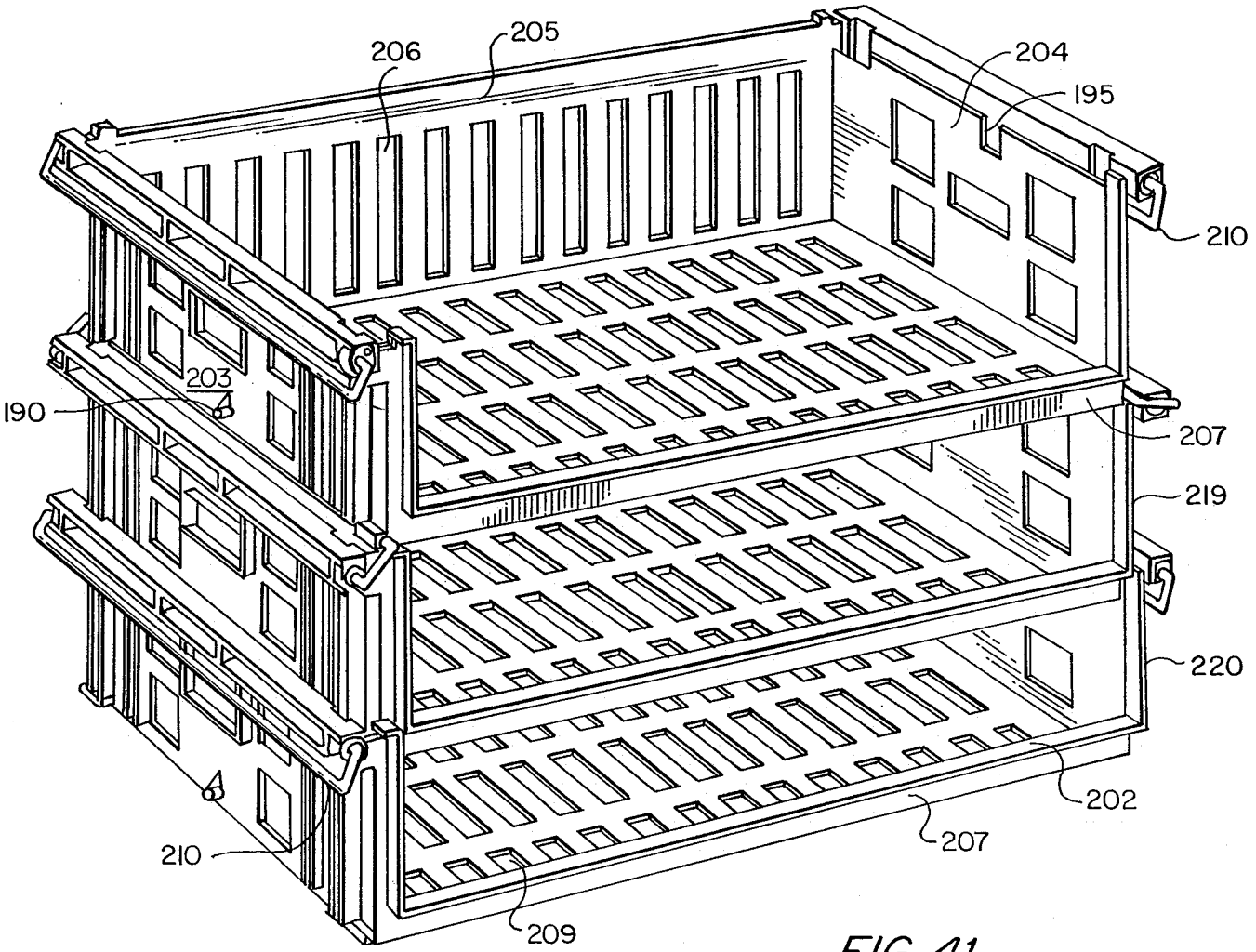
FIG. 41 is a perspective view of trays constructed according to a sixth embodiment of the invention having the blind unstacking feature.
Figure 42:
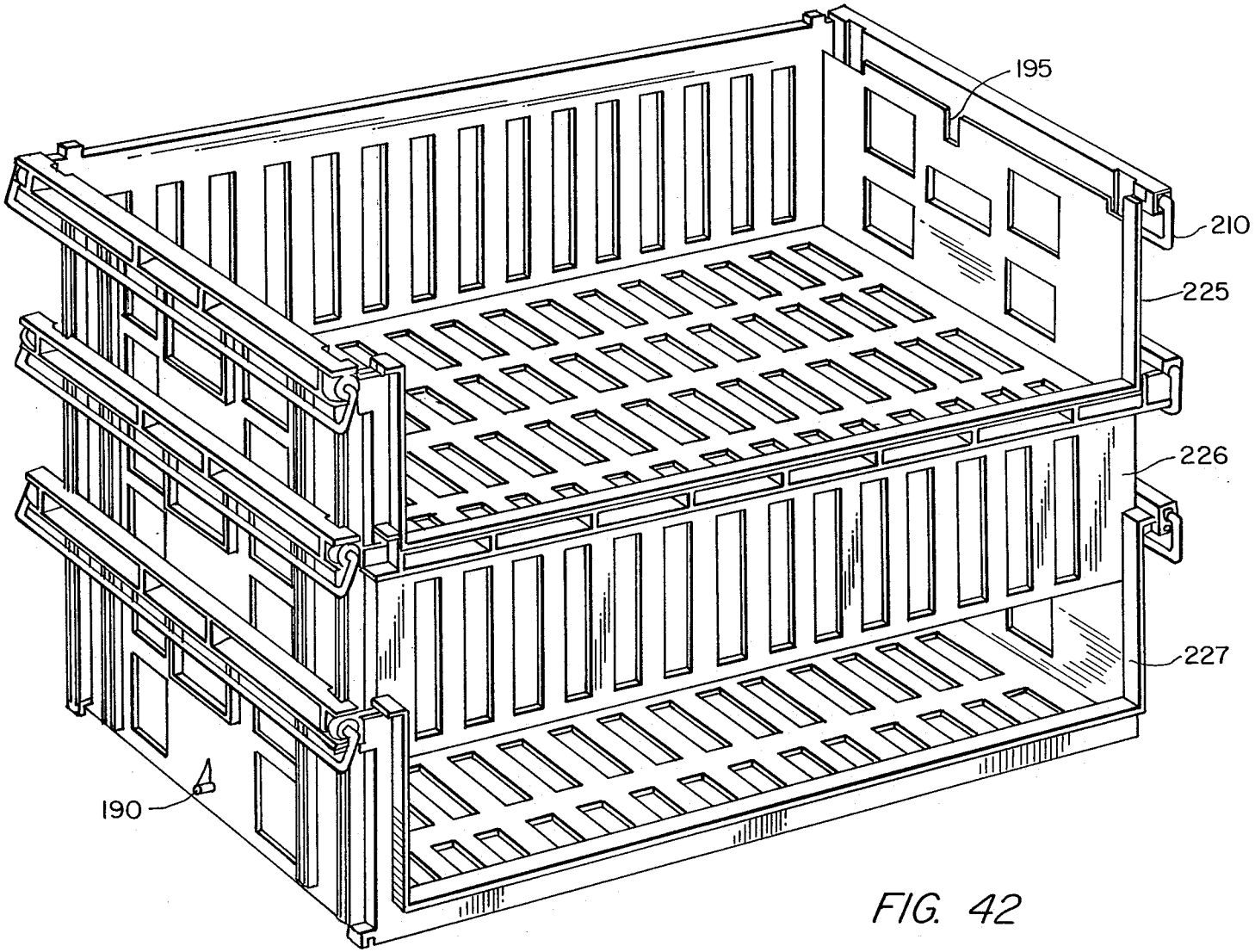
FIG. 42 is another perspective view of the trays constructed according to a sixth embodiment of the present invention.

In FIGS. 41 and 42, a sixth embodiment of the present invention is shown.

The trays or containers of FIG. 41 have opposite end walls 203 and 204, a bottom wall 202 having holes or apertures 209 extending therethrough and at least one side wall 205 having elongated slots 206 extending therethrough. Opposite from side wall 205 is a wall 207 that is shorter in height than wall 205, but of a size sufficient to enable articles to be contained within the tray.

The end wall structure of both end walls 203 and 204 is the same. Bales 210 are provided to swing between the two positions shown in order to provide two levels of stacking. In the lower stacked position, as shown between containers 219 and 220, the projections 190 are received within slots 195. Accordingly, to unstack the trays, the upper tray can be first pivoted to disengage the projections 190 from the slots 195 and thereafter pivoted about the projections 190 to facilitate unstacking.

In FIG. 42, a container is shown that is of a slightly modified construction to the container shown in FIG. 41, three different levels of stacking are obtainable, wherein containers 225 and 226 show one level of stacking and containers 226 and 227 show another level of stacking. A third level of stacking can be achieved by using the bales 210. As shown in FIG. 42, projections 190 and slots 195 are provided to assist in unstacking the containers.

While preferred embodiments have been described in detail, with the first embodiment including a set of different size trays, for the purpose of providing the best mode and for detailing specific advantageous features, further modifications, embodiments, and variations are contemplated all within the spirit and scope of the present invention as defined by the following claims.

We claim:

1. A container, for stacking with a plurality of like containers, wherein the container has at least a bottom and end walls, with the end walls having interengaging feet and recesses when two like trays are stacked, the improvement comprising:

at least one projection on the midportion of each said end wall;

at least one recess in the midportion of each said end wall for receiving therein with generally vertical telescoping relative movement, the corresponding projection of a like stacked container;

said feet and recesses at one side of like stacked containers providing first pivot means for pivoting the top one of the stacked containers generally about an axis at said one side sufficiently for said feet and recesses at the other side to become completely vertically disengaged and sufficiently for said projections and recesses in the midportion of said end walls to become completely vertically disengaged at pivoted angles of said containers above a generally fixed threshold angle, and said pivot means providing lost motion in generally the horizontal direction parallel to said end walls and in the direction from said first pivot means toward said midportion sufficiently to vertically misalign said projections and their adjacent recesses at said pivoted angles to where said containers assume a pivoted misaligned position;

support means on said end walls for supporting said projections outside of their recesses when said other sides of said containers are relatively pivoted towards each other from said pivoted misaligned position and constituting second pivot means for thereafter relatively pivoting said containers with respect to each other from pivot angles to a generally parallel relative position about said projections; and means for supporting the top one of said like containers on said end walls of the bottom one of said containers in said parallel relative position and providing generally horizontal sliding bearing surfaces to continue said supporting as said top one of said containers is slid horizontally in said direction for a substantial distance to where a substantial portion of the other side of a lower adjacent container to provide a greater portion of the top one of said containers for the user to grasp, whereby the containers may be unstacked while grasping only a side of the top container for moving it to an unstacked and horizontally misaligned position where a greater portion of the top container is available for grasping.

2. The container of claim 1, wherein said recesses associated with said feet are generally vertically extending slots having a width greater than the width of said feet, by an offset dimension; and said recesses associated with said projections being vertical slots having a width greater than the width of said projections by an amount substantially less than said offset dimension, with said widths and dimensions being measured in said direction.

3. The container of claim 2, wherein said container is generally rectangular in shape with four corners, and wherein each of said containers has feet and recesses on their end walls adjacent each of said four corners.

4. The container of claim 2, wherein said container has at least one side wall connected to and extending between said end walls.

5. The container of claim 2, wherein said container has opposite side walls respectively extending between said end walls and connected to said bottom.

6. A bakery tray container according to claim 5, wherein said side walls are substantially lower than said end walls;

said feet and recesses interengaging to support said trays in a high stacking position, and a lower nested position, in different relative positions of said trays.

7. The bakery tray container according to claim 6, wherein said feet and recesses interengage to support said trays in a high stacking position, a low stacking position, an intermediate stacking position, and a nesting position, with different relative positionings of the trays within each other.

8. The container according to claim 1, further including pivoting bales on opposed top walls of said container pivoting between an outwardly extending position wherein the containers may be nested within each other without interference from said bales and an inwardly extending position wherein said bales engage adjacent wall structure for supporting the bottom of a like top stacked container at a stacked position higher than said container when nested.

9. The container according to claim 1, constructed entirely of molded synthetic resin, with said side walls, end walls and bottom walls being homogeneously joined to each other to form a rectangular open top container.

10. In a unitary molded plastic bakery tray having a rectangular bottom, a pair of opposed side walls, a pair of opposed end walls, said side walls and end walls being alternately connected to each other and to said bottom around the perimeter of said bottom to provide an upwardly opening rectangular tray, and interengaging means along said end walls for providing first and second different vertical stacking positions of like trays in a like orientation and 180 degree rotated orientation, respectively, for holding therebetween bakery products of corresponding height during storage and transportation, wherein the improvement relating to facilitating blind stacking, comprises:

guide feet at the opposite ends of each of said end walls adjacent said bottom, and outwardly spaced from and separate from said interengaging means;

stacking rail means along the upper edge of each of said end walls being spaced outwardly from and separate from said interengaging means, said stacking rail means having recesses at its opposite ends vertically aligned with said guide feet respectively for freely receiving therein said guide feet to a nesting depth of like containers sufficiently for said interengaging means to provide each of said first and second stacking positions;

said stacking rail means between said guide recesses being of a continuous height and constructed to receive and support thereon said guide feet to maintain like orientation or 180 degree orientation like containers vertically spaced at a height greater than said first and second positions, so that when blind stacking containers, said guide feet engage said stacking rail means slidably along the entire length of said guide rail means to maintain said interengaging means spaced from each other and inoperative until said guide feet align with and interengage with said guide recesses;

means between said side walls for pivoting said tray about a midportion of said tray to disengage said guide feet along one of said end walls from the corresponding ones of said guide recesses of a lower stacked tray; and means along said end walls for receiving the pivoting means of an upper stacked tray when upper and lower trays are vertically aligned in said stacked position and means on said end walls for engaging the pivoting means of an upper stacked tray adjacent said means for receiving said pivoting means such that said pivoting means of an upper said tray is removed from said means for receiving said pivoting means in a lower said tray and thereafter the upper said tray is moved to position said pivoting means of the upper said tray such that the upper said tray is pivoted about said pivoting means from one of said side walls of said tray to disengage said guide feet from the corresponding ones of said recesses at the other of said side walls to permit said guide feet to slidably engage said stacking rail thus enabling the unstacking of an upper said tray from a lower said tray.

11. The tray according to claim 10, wherein said recesses have a horizontal dimension wider than the corresponding dimension of said guide feet such that an upper said tray can be lifted at one end of its side walls to cause said guide feet to engage a bottom of said recesses and pivot said tray about said guide feet to disengage said pivoting means from said means for receiving said pivoting means and thereafter said upper tray moved relative to the lower tray while maintaining engagement of the bottom of said guide feet with the bottom of said recesses to engage said pivoting means of an upper said tray on said means for engaging said pivoting means on a lower said tray for pivoting said upper tray about said pivoting means and disengaging said guide feet from said recesses at the other of said side walls of the upper tray.

12. The tray according to claim 10, wherein said pivoting means is a projecting member extending outwardly from a bottom portion of each of said end walls midway between said side walls and said means for receiving said pivoting means is a slot in said stacking rail means along each of said end walls, each of said slots being vertically aligned with each of said projecting members when said trays are stacked in vertical alignment with one another.

13. The tray according to claim 10, wherein said guide feet and stacking rail means engage during blind stacking and unstacking in both the like orientation and 180 degree orientation throughout the full length of said guide rail means for maintaining said interengaging means inoperatively spaced apart.

14. The tray according to claim 13, wherein said bottom and said side walls are constructed to provide linear sliding means slidably engaging continuously during blind stacking and unstacking to support the near portions of like containers while the far portions of like containers are supported with respect to each other by said guide feet portions and stacking rail means.

15. The tray according to claim 10, wherein said interengaging means include said support feet along one end wall being adjacent and on one side of said guide feet and said support feet on said other end wall being adjacent and on another side of said guide feet; and said stacking rail means having pockets of two depths for receiving predetermined ones of said support feet in 180 degree and like orientation to provide said first and second different vertical stacking positions respectively.

16. The tray according to claim 14, wherein said linear sliding means include said side walls having a top edge portion adjacent said end walls and said bottom being recessed upwardly with respect to said corners to form a sloped bottom wall adjacent said corners joining said recessed bottom and said corners at a position spaced inwardly of said guide feet for engaging said top edge portions of said side walls to raise the trailing edge of an upper tray during blind stacking of an upper tray on a lower tray permitting said guide feet to slide into a corresponding one of said recesses.

17. In a unitary molded plastic bakery tray having a rectangular bottom wall, a pair of opposed side walls, a pair of opposed end walls, said side walls and end walls being alternately connected to each other and to said bottom around the perimeter of said bottom to provide an upwardly opening rectangular tray, interengaging means providing high and low different vertical stacking positions in a like orientation and 180 degree orientation of like trays, respectively for holding therebetween bakery products of corresponding height during storage and transport of bakery products, wherein the improvement comprises:

said interengaging means including a top edge stacking rail, a parallel guide rail and an engaging surface between said rails along each of said end walls, a pattern of at least two small recesses and at least two large recesses extending downwardly in each of said guide rails, with the pattern of recesses in one guide rail being different from the pattern of recesses in the other guide rail, so that with 180 degree oriented like stacked trays, vertically adjacent small recesses of adjacent trays will be misaligned vertically of adjacent trays and vertically adjacent large recesses of adjacent trays will be misaligned vertically;

a pattern of at least two large feet and at least two small feet along the bottom of each of said end walls, the pattern of feet on one end wall being different from the other end wall, so that with 180 degree oriented like stacked trays, vertically adjacent large feet will be vertically misaligned and vertically adjacent small feet will be vertically misaligned with at least some of said feet engaging said engaging surface to provide the high position;

in the like oriented position of two stacked trays, the large feet of the upper tray will be received within the large recesses of the lower tray and the small feet of the upper tray will be received within the small recesses of the lower tray to provide a low stacked position; blind stacking means for providing continuous linear sliding engagement between upper and lower trays for both like orientation and 180 degree orientation, said blind stacking means including said large feet being coplanar with and outward in the sliding direction of said small feet and said large recesses being coplanar with and outward in the sliding direction of said small recesses, said guide rail being linear and uninterrupted between said recesses, said large feet having a bottom continuous linear sliding engagement surface of greater length in the sliding direction than the distance between said continuous linear surface across the top of said small recesses to smoothly span said small recesses, and said pair of large feet being closely adjacent said side walls and said pair of large recesses being closely adjacent said side walls;

said blind stacking means thereby providing continuous uninterrupted sliding engagement between the forward most large feet on opposite end walls with said engagement surface from an engaging position of said forwardmost one of said large feet of the upper tray slightly beyond vertical alignment with the rearmost one of said large recesses all of the way to the vertically aligned position of said blind stacking containers for both the like orientation and the 180 degree orientation; and blind unstacking means including a projection extending outwardly from a bottom portion of each of said end walls between said side walls for pivoting said tray about said projections, and said tray having a slot in each of said end walls in vertical alignment with said projections when said trays are in a vertical stack, said slots of a lower tray receiving said projections of an upper tray when said trays are in one of said stacked positions and said projections of an upper tray engaging said interengaging means of a lower tray when said projection is not vertically aligned with said slot such that one of said side walls of an upper said tray is raised with respect to the lower said tray to pivot the upper said tray about the large feet of the upper said tray at the other of said side walls of the upper said tray to displace said projections from said slots of the lower said tray whereby subsequent movement of the upper said tray with respect to the lower said tray to cause vertical misalignment between said projections of the upper said tray and the slots of the lower said tray enables said projections of the upper said tray to engage the interengaging means of the lower said tray to permit pivoting of said tray about said projections by lowering said one side wall and correspondingly raising the other of said side walls of the upper said tray to disengage said large feet and said small feet from said large and small recesses respectively at said other side of the upper said tray to enable unstacking the upper said tray from the lower said tray.

18. The tray according to claim 17, wherein said large recesses have a dimension in the sliding direction greater than the corresponding dimension of said large feet such that an upper said tray when raised at said one side thereof in respect to a lower said tray to disengage said projections from said slots is movable in an unstacking direction as a result of said large feet sliding within said large recesses to cause vertical misalignment between said projections and said slots of an upper said tray and a lower said tray respectively.

19. The tray according to claim 17, wherein there are only two of said large recesses, two of said small recesses, two of said large feet and two of said small feet on each of said end walls.

20. The tray according to claim 19, wherein the bottom surface of each of said large and small feet is downwardly channel shaped for receiving within said channel shape the guide rail of the lower of two stacked containers during blind stacking.

21. The tray according to claim 17, wherein the bottom surface of each of said large and small feet is downwardly channel shaped for receiving within said channel shape the guide rail of the lower of two stacked containers during blind stacking.

* * * * *